US010629999B2

(12) United States Patent
Howard

(10) Patent No.: US 10,629,999 B2
(45) Date of Patent: Apr. 21, 2020

(54) METHOD AND APPARATUS THAT ISOLATE POLARIZATIONS IN PHASED ARRAY AND DISH FEED ANTENNAS

(71) Applicant: John Howard, Upper Mount Bethel, PA (US)

(72) Inventor: John Howard, Upper Mount Bethel, PA (US)

( * ) Notice: Subject to any disclaimer, the term of this patent is extended or adjusted under 35 U.S.C. 154(b) by 440 days.

(21) Appl. No.: 15/616,472

(22) Filed: Jun. 7, 2017

(65) Prior Publication Data

US 2017/0310017 A1 Oct. 26, 2017

Related U.S. Application Data

(63) Continuation-in-part of application No. 15/190,965, filed on Jun. 23, 2016, now Pat. No. 10,141,640,
(Continued)

(51) Int. Cl.
*H01Q 21/00* (2006.01)
*H01Q 1/52* (2006.01)
(Continued)

(52) U.S. Cl.
CPC ..... *H01Q 21/0006* (2013.01); *H01Q 1/523* (2013.01); *H01Q 9/0435* (2013.01); *H01Q 21/065* (2013.01)

(58) Field of Classification Search
CPC ..... H01Q 21/0006; H01Q 9/0435; H01Q 21/065; H01Q 1/523; H01Q 3/2664; H01Q 3/2658; H01Q 5/35
See application file for complete search history.

(56) References Cited

U.S. PATENT DOCUMENTS 4,914,445 A * 4/1990 Shoemaker ..... H01Q 21/065 343/700 MS
7,327,317 B2 2/2008 Heiniger
(Continued)

FOREIGN PATENT DOCUMENTS

EP 3 261 177 A1 12/2017

OTHER PUBLICATIONS

Non-Final Office Action received for U.S. Appl. No. 13/479,928 dated Dec. 29, 2014, 22 pages.
(Continued)

*Primary Examiner* — Hai V Tran
*Assistant Examiner* — Michael M Bouizza
(74) *Attorney, Agent, or Firm* — FisherBroyles, LLP

(57) ABSTRACT

A multi-polarized scanning phased array antenna is provided, which includes a first element, second element, first feed line, second feed line, first 180 degree phase shifter, second 180 degree phase shifter, third 180 degree phase shifter, fourth 180 degree phase shifter, θ1 degree phase shifter, and θ2 degree phase shifter. The first element is fed with a first polarization signal at a first feed point and a third feed point, and a second polarization signal at a second feed point and a fourth feed point. The second element is fed with the first polarization signal at a fifth feed point and a seventh feed point, and the second polarization signal at a sixth feed point and an eighth feed point. The first feed line is coupled to the elements and associated with the first polarization. The second feed line is coupled to the plurality of elements and associated with the second polarization. The first 180 degree phase shifter is coupled in the first feed line between the first and third feed points, and the second 180 degree phase shifter is coupled in the second feed line between the second and fourth feed points. The third 180 degree phase shifter is coupled in the first feed line between the fifth and
(Continued)

seventh feed points, and the fourth 180 degree phase shifter is coupled in the second feed line between the sixth and eighth feed points. The θ1 degree phase shifter is coupled in the first feed line between the third and seventh feed points, and the θ2 degree phase shifter is coupled in the second feed line between the second and sixth feed points.

14 Claims, 5 Drawing Sheets

Related U.S. Application Data which is a continuation-in-part of application No. 13/479,928, filed on May 24, 2012, now Pat. No. 9,407,005.

(60) Provisional application No. 61/609,619, filed on Mar. 12, 2012.

(51) Int. Cl.
*H01Q 21/06* (2006.01)
*H01Q 9/04* (2006.01)

(56) References Cited

U.S. PATENT DOCUMENTS

| | | | | |
|---|---|---|---|---|
| 9,407,005 | B2 | 8/2016 | Howard et al. | |
| 10,141,640 | B2 | 11/2018 | Howard | |
| 2002/0014995 | A1 | 2/2002 | Roberts | |
| 2008/0100530 | A1 | 5/2008 | Manholm | |
| 2010/0103049 | A1 | 4/2010 | Tabakovic | |
| 2011/0001678 | A1 | 1/2011 | Hsu et al. | |
| 2011/0032079 | A1 | 2/2011 | Bloy et al. | |
| 2012/0306698 | A1 | 12/2012 | Warnick et al. | |
| 2013/0106671 | A1* | 5/2013 | Eom | H01O 9/0407 343/853 |
| 2013/0201065 | A1 | 8/2013 | Parsche | |
| 2013/0234908 | A1 | 9/2013 | Howard et al. | |
| 2017/0237179 | A1* | 8/2017 | Park | H01Q 21/065 343/893 |

OTHER PUBLICATIONS

Final Office Action received for U.S. Appl. No. 13/479,928 dated Jul. 10, 2015, 26 pages.
Non-Final Office Action received for U.S. Appl. No. 13/479,928 dated Oct. 5, 2015, 12 pages.
Notice of Allowance received for U.S. Appl. No. 13/479,928 dated Mar. 25, 2016, 35 pages.
Non-Final Office Action received for U.S. Appl. No. 15/190,965 dated Nov. 30, 2017, 23 pages.
Final Office Action received for U.S. Appl. No. 15/190,965 dated Jun. 13, 2018, 19 pages.
Notice of Allowance received for U.S. Appl. No. 15/190,965 dated Oct. 3, 2018, 15 pages.
Extended European Search Report for corresponding EP Patent Application No. 17176162.0, dated Nov. 15, 2017, 8 pages.
Communication pursuant to Article 94(3) EPC received for EP Patent Application Serial No. 17176162.0 dated Sep. 27, 2018, 5 page.
Communication pursuant to Article 94(3) EPC received for EP Patent Application Serial No. 17176162.0 dated May 23, 2019, 4 page.
J.R. James, P.S. Hall, and C. Wood, "Microstrip Antenna—Theory and Design", The Institution of Electrical Engineers, London and New York, Peter Peregrinus LTD., Stevenage, UK, and New York, p. 82 (1981).
P. Bhartia, K.V.S. Rao, and R.S. Tomar, "Millimeter-Wave Microstrip and Printed Circuit Antennas", Artech House, Inc., pp. 127-130 (1991).

* cited by examiner

METHOD AND APPARATUS THAT ISOLATE POLARIZATIONS IN PHASED ARRAY AND DISH FEED ANTENNAS

CROSS-REFERENCE TO RELATED APPLICATIONS

This application is a continuation-in-part application of U.S. application Ser. No. 15/190,965, filed Jun. 23, 2016, which is a continuation-in-part application of U.S. application Ser. No. 13/479,928, filed May 24, 2012, which claims the benefit of U.S. Provisional Application No. 61/609,619, filed Mar. 12, 2012, the disclosures of which are incorporated by reference herein in their entireties

BACKGROUND

Field

The disclosed subject matter generally relates to antennas and, more particularly, relates to devices and methods that increase isolation between polarizations associated with phased array antennas and dish feed antennas.

Related Art

One of the major challenges in antenna design is to provide the highest gain in the smallest possible area, while providing the greatest degree of isolation between differently polarized signals being transmitted and received by the antenna.

SUMMARY

Various embodiments of the invention relate to a device, method, and system to increase isolation between different polarizations associated with a phased array antenna. A multi-polarized scanning phased array antenna includes a plurality of elements, a horizontal feed line operatively coupled to the plurality of elements, and a vertical feed line operatively coupled to the plurality of elements.

A multi-polarized scanning phased array antenna is provided, which includes a plurality of elements, a first feed line operatively coupling the plurality of elements, a second feed line operatively coupling the plurality of elements, and a phase delay operatively coupled in at least one of the first feed line and the second feed line. The phase delay is configured to cancel a polarized signal associated with the multi-polarized scanning phased array antenna.

The plurality of elements may include a first element, second element, third element, and fourth element. A first set of elements may include the first and second elements, a second set of elements may include the third and fourth elements, a third set of elements may include the first and third elements, and a fourth set of elements may include the second and fourth elements. The phase delay may include a first phase delay operatively coupled in the first feed line between the third and fourth sets of elements, and a second phase delay operatively coupled in the second feed line between the first and second sets of elements. At least one of the first and second phase delays may include a 180° phase shift. The first, second, third, and fourth elements may be operatively coupled by the second feed line and the first feed line.

The phase delay may include a first phase delay operatively coupled in the first feed line between the third and fourth sets of elements, a second phase delay operatively coupled in the second feed line between the first and second elements, and a third phase delay operatively coupled in the second feed line between the third and fourth elements. The first phase delay may include a 180° phase shift, the second phase delay may include a 180° phase shift, and the third phase delay may include a 180° phase shift and at least one θ° phase shift, wherein θ° represents an angle of elevation scanning.

The phase delay may include a first phase delay operatively coupled in the second feed line between the first and second sets of elements, a second phase delay operatively coupled in the first feed line between the first and third elements, and a third phase delay operatively coupled in the first feed line between the second and fourth elements. The first phase delay may include a 180° phase shift, the second phase delay may include a 180° phase shift, and the third phase delay may include a 180° phase shift and at least one θ° phase shift, wherein θ° represents an angle of azimuth scanning.

The phase delay may include a first phase delay operatively coupled in the first feed line between the first and third elements, a second phase delay operatively coupled in the first feed line between the second and fourth elements, a third phase delay operatively coupled in the second feed line between the first and second elements, and a fourth phase delay operatively coupled in the second feed line between the third and fourth elements. The first phase delay may include a 180° phase shift, the second phase delay may include a 180° phase shift and at least one θ2° phase shift, the third phase delay may include a 180° phase shift, and the fourth phase delay may include a 180° phase shift and at least one θ1° phase shift, wherein θ1° represents an angle of elevation scanning and θ2° represents an angle of azimuth scanning.

The plurality of elements may include a patch antenna. The first feed line may be configured to at least one of transmit and receive at least one of a vertically polarized signal, horizontally polarized signal, right-hand clockwise circularly polarized signal, and left-hand counterclockwise circularly polarized signal. The second feed line may be configured to at least one of transmit and receive at least one of a vertically polarized signal, horizontally polarized signal, right-hand clockwise circularly polarized signal, and left-hand counterclockwise circularly polarized signal. The first feed line may be configured to be a horizontal feed line, and the second feed line may be configured to be a vertical feed line.

A method of increasing isolation between polarizations in a multi-polarized scanning phased array antenna is provided, which includes coupling a plurality of elements operatively with a first feed line, coupling the plurality of elements operatively with a second feed line, and coupling a phase delay operatively in at least one of the first feed line and the second feed line such that a polarized signal associated with the multi-polarized scanning phased array antenna is cancelled.

Coupling the phase delay may include coupling a first phase delay operatively in the first feed line between the third and fourth sets of elements, and coupling a second phase delay operatively in the second feed line between the first and second sets of elements. At least one of the first and second phase delays may include a 180° phase shift.

Coupling the phase delay may include coupling a first phase delay operatively in the first feed line between the third and fourth sets of elements, coupling a second phase delay operatively in the second feed line between the first and second elements, and coupling a third phase delay operatively in the second feed line between the third and fourth elements. The first phase delay may include a 180° phase shift, the second phase delay may include a 180° phase shift, and the third phase delay may include a 180° phase shift and at least one θ° phase shift, wherein θ° represents an angle of elevation scanning. The method may include coupling the first, second, third, and fourth elements operatively by the second feed line, and coupling the first, second, third, and fourth elements operatively by the first feed line.

Coupling the phase delay may include coupling a first phase delay operatively in the second feed line between the first and second sets of elements, coupling a second phase delay operatively in the first feed line between the first and third elements, and coupling a third phase delay operatively in the first feed line between the second and fourth elements. The first phase delay may include a 180° phase shift, the second phase delay may include a 180° phase shift, and the third phase delay may include a 180° phase shift and at least one θ° phase shift, wherein θ° represents an angle of azimuth scanning.

Coupling the phase delay may include coupling a first phase delay operatively in the first feed line between the first and third elements, coupling a second phase delay operatively in the first feed line between the second and fourth elements, coupling a third phase delay operatively in the second feed line between the first and second elements, and coupling a fourth phase delay operatively in the second feed line between the third and fourth elements. The first phase delay may include a 180° phase shift, the second phase delay may include a 180° phase shift and at least one θ2° phase shift, the third phase delay may include a 180° phase shift, and the fourth phase delay may include a 180° phase shift and at least one θ1° phase shift, wherein θ1° represents an angle of elevation scanning and θ2° represents an angle of azimuth scanning The method may include configuring the first feed line to at least one of transmit and receive at least one of a vertically polarized signal, horizontally polarized signal, right-hand clockwise circularly polarized signal, and left-hand counterclockwise circularly polarized signal. The method may include configuring the second feed line to at least one of transmit and receive at least one of a vertically polarized signal, horizontally polarized signal, right-hand clockwise circularly polarized signal, and left-hand counterclockwise circularly polarized signal. The method may include configuring the first feed line to be a horizontal feed line, and configuring the second feed line to be a vertical feed line.

A multi-polarized phased array antenna is provided, which includes an element, a first feed line, a second feed line, a first phase shifter, and a second phase shifter. The element is fed with a first polarization signal at a first angle, a second polarization signal at a second angle, the first polarization signal at a third angle, and the second polarization signal at a fourth angle. The first polarization signal includes a first polarization, and the second polarization signal includes a second polarization. The first polarization is different from the second polarization. The first feed line operatively couples the first polarization signal to the element, and the first feed line is associated with the first polarization. The second feed line operatively couples the second polarization signal to the element, and the second feed line is associated with the second polarization. The first phase shifter is operatively coupled in the first feed line, and the second phase shifter is operatively coupled in the second feed line. One of the first polarization signal and the second polarization signal is cancelled at a feed point in at least one of the first feed line and the second feed line by operation of the first phase shifter, second phase shifter, first angle, second angle, third angle, and fourth angle. At least one of the first phase shifter and the second phase shifter includes at least one of a digital phase shifter and analog phase shifter. The analog phase shifter includes at least one length of conductor in addition to that required to couple at least one of (1) the first feed line across the first phase shifter and (2) the second feed line across the second phase shifter using a straight conductor. The first phase shifter provides a first 180° phase shift between the first and third angles, and the second phase shifter provides a second 180° phase shift between the second and fourth angles.

The first feed line may be bent in only right angles, and the second feed line may be bent in only right angles. The element may be a patch antenna. The first feed line may at least one of transmit and receive at least one of a vertically polarized signal, horizontally polarized signal, right-hand clockwise circularly polarized signal, and left-hand counterclockwise circularly polarized signal. The second feed line may at least one of transmit and receive at least one of a vertically polarized signal, horizontally polarized signal, right-hand clockwise circularly polarized signal, and left-hand counterclockwise circularly polarized signal. The first feed line may be a horizontally polarized feed line, and the second feed line may be a vertically polarized feed line.

A method of increasing isolation between polarizations in a multi-polarized phased array antenna includes coupling an element operatively to a first polarization signal using a first feed line, coupling the element operatively to the second polarization signal using a second feed line, coupling a first phase shifter operatively in the first feed line, and coupling a second phase shifter operatively in the second feed line. The element is fed with the first polarization signal at a first angle, a second polarization signal at a second angle, the first polarization signal at a third angle, and the second polarization signal at a fourth angle. The first polarization signal includes a first polarization, and the second polarization signal comprising a second polarization. The first polarization is different from the second polarization. The first feed line is associated with the first polarization, and the second feed line is associated with the second polarization. At least one of the first phase shifter and the second phase shifter includes at least one of a digital phase shifter and an analog phase shifter. The analog phase shifter includes at least one length of conductor in addition to that required to couple at least one of (1) the first feed line across the first phase shifter using a straight conductor 1 and (2) the second feed line across the second phase shifter using a straight conductor. The at least one length of conductor provides a phase shift. The first phase shifter provides a first 180° phase shift between (1) the first and third angles, and the second phase shifter provides a second 180° phase shift between the second and fourth angles.

The first feed line may be bent in only right angles, and the second feed line may be bent in only right angles. The method may include configuring the first feed line to at least one of transmit and receive at least one of a vertically polarized signal, horizontally polarized signal, right-hand clockwise circularly polarized signal, and left-hand counterclockwise circularly polarized signal. The method may include configuring the second feed line to at least one of transmit and receive at least one of a vertically polarized signal, horizontally polarized signal, right-hand clockwise circularly polarized signal, and left-hand counterclockwise circularly polarized signal. The method may include configuring the first feed line to be a horizontally polarized feed line, and configuring the second feed line to be a vertically polarized feed line.

A multi-polarized scanning phased array antenna is provided, which includes a plurality of elements including a first element and a second element, a first feed line, a second feed line, a first 180 degree phase shifter, a second 180 degree phase shifter, a third 180 degree phase shifter, a fourth 180 degree phase shifter, a θ1 degree phase shifter, and θ2 degree phase shifter. The first element is fed with a first polarization signal at a first feed point and a third feed point, and the first element is fed with a second polarization signal at a second feed point and a fourth feed point. The second element is fed with the first polarization signal at a fifth feed point and a seventh feed point, and the second element is fed with the second polarization signal at a sixth feed point and an eighth feed point. The first polarization signal includes a first polarization, and the second polarization signal includes a second polarization. The first polarization is different from the second polarization. The first feed line is operatively coupled to the plurality of elements, and associated with the first polarization. The second feed line is operatively coupling to the plurality of elements, and associated with the second polarization. The first 180 degree phase shifter is operatively coupled in the first feed line between the first and third feed points, and the second 180 degree phase shifter is operatively coupled in the second feed line between the second and fourth feed points. The third 180 degree phase shifter is operatively coupled in the first feed line between the fifth and seventh feed points, and the fourth 180 degree phase shifter is operatively coupled in the second feed line between the sixth and eighth feed points. The θ1 degree phase shifter is operatively coupled in the first feed line between the third and seventh feed points, and the θ2 degree phase shifter is operatively coupled in the second feed line between the second and sixth feed points.

The first feed line can be bent in only right angles, and the second feed line may be bent in only right angles. The element can include a patch antenna. The first feed line can at least one of transmit and receive at least one of a vertically polarized signal, horizontally polarized signal, right-hand clockwise circularly polarized signal, and left-hand counterclockwise circularly polarized signal. The second feed line can at least one of transmit and receive at least one of a vertically polarized signal, horizontally polarized signal, right-hand clockwise circularly polarized signal, and left-hand counterclockwise circularly polarized signal. The first feed line can be a horizontally polarized feed line, and the second feed line can be a vertically polarized feed line.

A multi-polarized scanning phased array antenna is provided, which includes a plurality of elements, a first feed line, a second feed line, a first 180 degree phase shifter, a second 180 degree phase shifter, a third 180 degree phase shifter, a fourth 180 degree phase shifter, a fifth 180 degree phase shifter, a sixth 180 degree phase shifter, a seventh 180 degree phase shifter, an eighth 180 degree phase shifter, a first θ1 degree phase shifter, a second θ1 degree phase shifter, a θ2 degree phase shifter, a θ3 phase shifter, a first θ4 phase shifter, and a second θ4 phase shifter. The plurality of elements includes a first element, a second element, a third element, and a fourth element. The first element is fed with a first polarization signal at a first feed point and a third feed point, and the first element is fed with a second polarization signal at a second feed point and a fourth feed point. The second element is fed with the first polarization signal at a fifth feed point and a seventh feed point, and the second element is fed with the second polarization signal at a sixth feed point and an eighth feed point. The third element is fed with the first polarization signal at a ninth feed point and a eleventh feed point, and the third element is fed with the second polarization signal at a tenth feed point and a twelfth feed point. The fourth element is fed with the first polarization signal at a thirteenth feed point and a fifteenth feed point, and the fourth element is fed with the second polarization signal at a fourteenth feed point and a sixteenth feed point. The first polarization signal includes a first polarization, and the second polarization signal includes a second polarization. The first polarization is different from the second polarization. The first feed line is operatively coupling the plurality of elements, and is associated with the first polarization. The second feed line is operatively coupling the plurality of elements, and is associated with the second polarization. The first 180 degree phase shifter is operatively coupled in the first feed line between the first and third feed points, and the second 180 degree phase shifter is operatively coupled in the second feed line between the second and fourth feed points. The third 180 degree phase shifter is operatively coupled in the first feed line between the fifth and seventh feed points, and the fourth 180 degree phase shifter is operatively coupled in the second feed line between the sixth and eighth feed points. The fifth 180 degree phase shifter is operatively coupled in the first feed line between the ninth and eleventh feed points, and the sixth 180 degree phase shifter is operatively coupled in the second feed line between the tenth and twelfth feed points. The seventh 180 degree phase shifter is operatively coupled in the first feed line between the thirteenth and fifteenth feed points, and the eighth 180 degree phase shifter is operatively coupled in the second feed line between the fourteenth and sixteenth feed points. The first θ1 degree phase shifter is operatively coupled in the first feed line between the third and fifteenth feed points, and the second θ1 degree phase shifter is operatively coupled in the first feed line between the eleventh and seventh feed points. The θ2 degree phase shifter is operatively coupled in the second feed line between the fourth and eighth feed points, and the θ3 phase shifter is operatively coupled in the first feed line between the third and eleventh feed points. The first θ4 phase shifter is operatively coupled in the second feed line between the fourth and twelfth feed points, and the second θ4 phase shifter is operatively coupled in the second feed line between the eighth and sixteenth feed points.

A multi-polarized scanning phased array antenna is provided, which includes a plurality of elements, a first feed line, a second feed line, a first 180 degree phase shifter, a second 180 degree phase shifter, a third 180 degree phase shifter, a fourth 180 degree phase shifter, a fifth 180 degree phase shifter, a sixth 180 degree phase shifter, a θ1 degree phase shifter, and a θ2 degree phase shifter. The plurality of elements includes a first element, a second element, and a third element. The first element is fed with a first polarization signal at a first feed point and a third feed point, and the first element is fed with a second polarization signal at a second feed point and a fourth feed point. The second element is fed with the first polarization signal at a fifth feed point and a seventh feed point, and the second element is fed with the second polarization signal at a sixth feed point and an eighth feed point. The third element is fed with the first polarization signal at a ninth feed point and an eleventh feed point, and the second element is fed with the second polarization signal at a tenth feed point and a twelfth feed point, The first polarization signal includes a first polarization, and the second polarization signal includes a second polarization. The first polarization is different from the second polarization. The first feed line is operatively coupling the plurality of elements, and associated with the first polarization. The second feed line is operatively coupling the plurality of elements, and associated with the second polarization. The first 180 degree phase shifter is operatively coupled in the first feed line between the first and third feed points, and the second 180 degree phase shifter is operatively coupled in the second feed line between the second and fourth feed points. The third 180 degree phase shifter is operatively coupled in the first feed line between the fifth and seventh feed points, and the fourth 180 degree phase shifter is operatively coupled in the second feed line between the sixth and eighth feed points. The fifth 180 degree phase shifter is operatively coupled in the first feed line between the ninth and eleventh feed points, and the sixth 180 degree phase shifter is operatively coupled in the second feed line between the tenth and twelfth feed points. The θ1 degree phase shifter is operatively coupled in the first feed line between the third and seventh feed points, and the θ2 degree phase shifter is operatively coupled in the second feed line between the second and sixth feed points.

A method of increasing isolation between polarizations in a multi-polarized scanning phased array antenna is provided, which includes: coupling a plurality of elements operatively with a first feed line, wherein the plurality of elements includes a first element and a second element, the first element is fed with a first polarization signal at a first feed point and a third feed point, the first element is fed with a second polarization signal at a second feed point and a fourth feed point, the second element is fed with the first polarization signal at a fifth feed point and a seventh feed point, the second element is fed with the second polarization signal at a sixth feed point and an eighth feed point, the first polarization signal includes a first polarization, the second polarization signal includes a second polarization, the first polarization is different from the second polarization, and the first feed line is associated with the first polarization; coupling the plurality of elements operatively with a second feed line, wherein the second feed line is associated with the second polarization; coupling a first 180 degree phase shifter operatively in the first feed line between the first and third feed points; coupling a second 180 degree phase shifter operatively in the second feed line between the second and fourth feed points; coupling a third 180 degree phase shifter operatively in the first feed line between the fifth and seventh feed points; coupling a fourth 180 degree phase shifter operatively in the second feed line between the sixth and eighth feed points; coupling a θ1 degree phase shifter operatively in the first feed line between the third and seventh feed points; and coupling a θ2 degree phase shifter operatively in the second feed line between the second and sixth feed points.

The method of increasing isolation between polarizations in a multi-polarized scanning phased array antenna can include bending the first feed line in only right angles, and bending the second feed line in only right angles. The element can include a patch antenna. The method can include at least one of transmitting, receiving by the first feed line at least one of a vertically polarized signal, horizontally polarized signal, right-hand clockwise circularly polarized signal, left-hand counterclockwise circularly polarized signal. The method can include at least one of transmitting, receiving by the second feed line at least one of a vertically polarized signal, horizontally polarized signal, right-hand clockwise circularly polarized signal, left-hand counterclockwise circularly polarized signal. The first feed line can be a horizontally polarized feed line, and the second feed line can be a vertically polarized feed line.

A method of increasing isolation between polarizations in a multi-polarized scanning phased array antenna is provided, which includes: coupling a plurality of elements operatively with a first feed line, wherein the plurality of elements includes a first element, a second element, a third element, and a fourth element, the first element is fed with a first polarization signal at a first feed point and a third feed point, the first element is fed with a second polarization signal at a second feed point and a fourth feed point, the second element is fed with the first polarization signal at a fifth feed point and a seventh feed point, the second element is fed with the second polarization signal at a sixth feed point and an eighth feed point, the third element is fed with the first polarization signal at a ninth feed point and a eleventh feed point, the third element is fed with the second polarization signal at a tenth feed point and a twelfth feed point, the fourth element is fed with the first polarization signal at a thirteenth feed point and a fifteenth feed point, the fourth element is fed with the second polarization signal at a fourteenth feed point and a sixteenth feed point, the first polarization signal including a first polarization, the second polarization signal including a second polarization, the first polarization is different from the second polarization, the first feed line is associated with the first polarization; coupling the plurality of elements operatively with a second feed line, wherein the second feed line is associated with the second polarization; coupling a first 180 degree phase shifter operatively in the first feed line between the first and third feed points; coupling a second 180 degree phase shifter operatively in the second feed line between the second and fourth feed points; coupling a third 180 degree phase shifter operatively in the first feed line between the fifth and seventh feed points; coupling a fourth 180 degree phase shifter operatively in the second feed line between the sixth and eighth feed points; coupling a fifth 180 degree phase shifter operatively in the first feed line between the ninth and eleventh feed points; coupling a sixth 180 degree phase shifter operatively in the second feed line between the tenth and twelfth feed points; coupling a seventh 180 degree phase shifter operatively in the first feed line between the thirteenth and fifteenth feed points; coupling an eighth 180 degree phase shifter operatively in the second feed line between the fourteenth and sixteenth feed points; coupling a first θ1 degree phase shifter operatively in the first feed line between the third and fifteenth feed points; coupling a second θ1 degree phase shifter operatively in the first feed line between the eleventh and seventh feed points; coupling a θ2 degree phase shifter operatively in the second feed line between the fourth and eighth feed points; coupling a θ3 phase shifter operatively in the first feed line between the third and eleventh feed points; coupling a first θ4 phase shifter operatively in the second feed line between the fourth and twelfth feed points; and coupling a second θ4 phase shifter operatively in the second feed line between the eighth and sixteenth feed points.

A method of increasing isolation between polarizations in a multi-polarized scanning phased array antenna is provided, which includes: coupling a plurality of elements operatively with a first feed line, wherein the plurality of elements includes a first element, a second element, and a third element, the first element is fed with a first polarization signal at a first feed point and a third feed point, the first element is fed with a second polarization signal at a second feed point and a fourth feed point, the second element is fed with the first polarization signal at a fifth feed point and a seventh feed point, the second element is fed with the second polarization signal at a sixth feed point and an eighth feed point, the third element is fed with the first polarization signal at a ninth feed point and an eleventh feed point, the second element is fed with the second polarization signal at a tenth feed point and a twelfth feed point the first polarization signal includes a first polarization, the second polarization signal includes a second polarization, the first polarization is different from the second polarization, and the first feed line is associated with the first polarization; coupling the plurality of elements operatively with a second feed line, wherein the second feed line is associated with the second polarization; coupling a first 180 degree phase shifter operatively in the first feed line between the first and third feed points; coupling a second 180 degree phase shifter operatively in the second feed line between the second and fourth feed points; coupling a third 180 degree phase shifter operatively in the first feed line between the fifth and seventh feed points; coupling a fourth 180 degree phase shifter operatively in the second feed line between the sixth and eighth feed points; coupling a fifth 180 degree phase shifter operatively in the first feed line between the ninth and eleventh feed points; coupling a fourth 180 degree phase shifter operatively in the second feed line between the tenth and twelfth feed points; coupling a θ1 degree phase shifter operatively in the first feed line between the third and seventh feed points; and coupling a θ2 degree phase shifter operatively in the second feed line between the second and sixth feed points.

Other embodiments will become apparent from the following detailed description considered in conjunction with the accompanying drawings. It is to be understood, however, that the drawings are designed as an illustration only and not as a definition of the limits of any of the embodiments.

BRIEF DESCRIPTION OF THE DRAWINGS

The following drawings are provided by way of example only and without limitation, wherein like reference numerals (when used) indicate corresponding elements throughout the several views, and wherein.

It is to be appreciated that elements in the figures are illustrated for simplicity and clarity. Common but well-understood elements that are useful or necessary in a commercially feasible embodiment are not shown in order to facilitate a less hindered view of the illustrated embodiments.

DETAILED DESCRIPTION

In the case of dual polarized antennas, such as antennas utilizing linear polarization, reductions in area are achieved by introducing both polarizations in a plurality of single elements associated with the phased array or, in the case of two separate elements each having a single polarization, by providing dual polarizations that occupy the same area. To do this, the polarizations (such as vertical and horizontal) are provided by the same antenna element. However, proximity between phased array elements creates additional challenges, such as maintaining isolation between polarizations. Accordingly, embodiments of the invention improve isolation between different polarizations in multi-polarized phased array antennas. Embodiments of the invention also cancel a polarization signal while another polarization signal is active.

Figure 1:
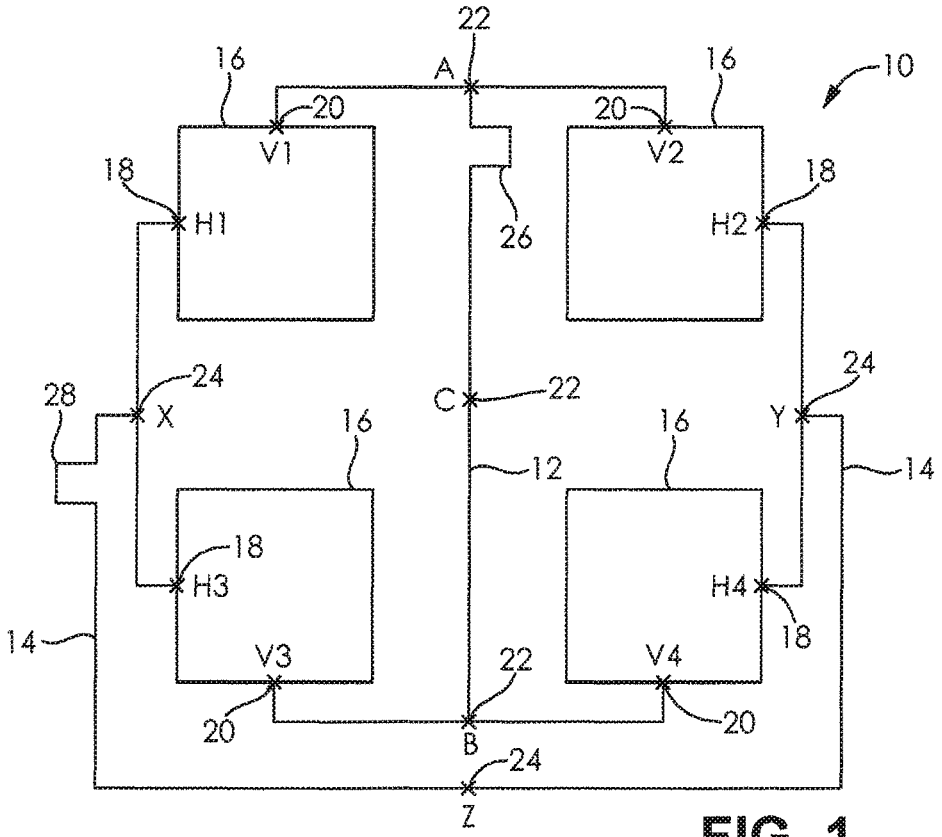
FIG. 1 shows an antenna having vertical and horizontal polarization feed lines without azimuth or elevation scanning in accordance with a first embodiment of the invention.

FIG. 1 shows an antenna 10 having vertical and horizontal polarization feed lines without azimuth or elevation scanning. The antenna 10 transmits and receives in two polarizations, such as two linear polarizations, such as vertical and horizontal polarizations. However, embodiments of the invention are equally applicable to circular polarizations. Line 12 represents a vertical polarization feed line, line 14 represents a horizontal polarization feed line, and squares represent antenna elements 16. Feed points V1, V2, V3, V4 represent vertical polarization feed points 18, and feed points H1, H2, H3, H4 represent horizontal polarization feed points 20. Connection points A, B, C represent connection points 22 for the vertical polarization feed line 12, and connection points X, Y, Z represent connection points 24 for the horizontal polarization feed line 14.

FIG. 1 shows an embodiment of the invention including a single element for dual linear polarization, which is equally applicable to all types of antennas. Signals arriving from connection point A to connection point C and connection point X to connection point Z experience an additional 180-degree phase shift 26, 28, respectively, either due to an additional length of conductor 26, 28 for a narrowband signal or a phase shifter with a 180° hybrid (not shown) for a wideband signal. That is, if the application is narrowband, such as rates up to 1.544 Mbps, the additional length of conductor is used, and if the application is wideband, such as 64 Kbps to 2 Mbps, the 180° hybrid is used. In broadband applications, the 180° phase shift can be added by using hybrids, digital phase shifters, and/or analog phase shifters.

In a first example implementation of the embodiment shown in FIG. 1, horizontal polarization is received by the vertical feed line 12. Specifically, signal V1 is fed at vertical polarization feed point V1 20 at an angle of 0°, signal V2 is fed at vertical polarization feed point V2 20 at an angle of 0°, signal V3 is fed at vertical polarization feed point V3 20 at an angle of 0° , and signal V4 is fed at vertical polarization feed point V4 20 at an angle of 0°. For normalized feed signals, V1=V2=V3=V4=1. The signal at connection point A equals V1 at 0°+V2 at 0°, and the signal at connection point B equals V3 at 0°+V4 at 0°. All four signals add at connection point C to equal V1 at 180°+V2 at 180°+V3 at 0°+V4 at 0°. Therefore, the signal at connection point C is equal to −V1 at 0°−V2 at 0°+V3 at 0°+V4 at 0°, which equals 0. Since the magnitudes of the signals are equal, the signals cancel each other, which indicate that undesirable horizontal polarization signal magnitudes become zero at connection point C. Connection point C is the output of the vertical polarization feed line while the antenna 10 is receiving. As indicated above, no horizontal polarization signal is received at connection point C. Thus, isolation is increased to infinity, which shows that one element can be used for both polarizations simultaneously without any isolation issues.

In a second example implementation of the embodiment shown in FIG. 1, vertical polarization is received by the vertical feed line 12. Specifically, signal V1 is fed at vertical polarization feed point V1 at an angle of 180°, signal V2 is fed at vertical polarization feed point V2 20 at an angle of 180°, signal V3 is fed at vertical polarization feed point V3 20 at an angle of 0°, and signal V4 is fed at vertical polarization feed point V4 20 at an angle of 0°. For normalized feed signals, V1=V2=V3=V4=1. The signal at connection point A equals V1 at 180°+V2 at 180°, and the signal at connection point B equals V3 at 0°+V4 at 0°. All four signals add at connection point C to equal V1 at 360°+V2 at 360°+V3 at 0°+V4 at 0°. Since a 360° degree phase shift is equivalent to a 0° degree phase shift, the signal at connection point C can be rewritten as V1 at 0°+V2 at 0°+V3 at 0°+V4 at 0°. This result indicates that a vertical polarization signal can be received and transmitted from the vertical feed line 12 without cancellation or degradation. Connection point C is the output of the vertical polarization feed line 12 while the antenna 10 is receiving. As indicated above, at connection point C, the vertical signal is received without cancelation or attenuation as desired while no horizontal polarization signal is received. This shows that one element can be used for both polarizations simultaneously without cancellation or attenuation issues.

In a third example implementation of the embodiment shown in FIG. 1, vertical polarization is received by the horizontal feed line 14. Specifically, signal H1 is fed at horizontal polarization feed point H1 18 at an angle of 0°, signal H2 is fed at horizontal polarization feed point H2 18 at an angle of 0°, signal H3 is fed at horizontal polarization feed point H3 18 at an angle of 0°, and signal H4 is fed at horizontal polarization feed point H4 18 at an angle of 0°. For normalized feed signals, H1=H2=H3=H4=1. The signal at connection point X equals H1 at 0°+H2 at 0°, and the signal at connection point Y equals H3 at 0°+H4 at 0°. All four signals add at connection point Z to equal H1 at 180°+H2 at 0°+H3 at 180°+H4 at 0°. Therefore, the signal at connection point Z is equal to −H1 at 0°+H2 at 0°−H3 at 0°+H4 at 0°, which equals 0. Since the magnitudes of the signals are equal, the signals cancel each other, which indicate that the magnitude of undesirable vertical polarization signals becomes zero at point Z, which is the horizontal polarization feed point. Therefore, complete isolation between polarizations is achieved in this configuration. Connection point Z is the output of the horizontal polarization feed line 14 while the antenna 10 is receiving. As indicated above, no vertical polarization signal is received at connection point Z. The isolation is increased to infinity, which indicates that one element can be used for both polarizations simultaneously without isolation issues.

In a fourth example implementation of the embodiment shown in FIG. 1, horizontal polarization is received by the horizontal feed line 14. Specifically, signal H1 is fed at horizontal polarization feed point H1 at an angle of 180°, signal H2 is fed at horizontal polarization feed point H2 at an angle of 0°, signal H3 is fed at horizontal polarization feed point H3 at an angle of 180°, and signal H4 is fed at horizontal polarization feed point H4 at an angle of 0°. For normalized feed signals, H1=H2=H3=H4=1. The signal at connection point X equals H1 at 180°+H3 at 180°, and the signal at connection point Y equals H2 at 0°+H4 at 0°. All four signals add at connection point Z to equal H1 at 360°+H2 at 0°+H3 at 360°+H4 at 0°. Since a 360° degree phase shift is equivalent to a 0° degree phase shift, the signal at point Z can be rewritten as H1 at 0°+H2 at 0°+H3 at 0°+H4 at 0°. This result indicates that a horizontal polarization signal can be received and transmitted from the horizontal feed line without cancellation or degradation. Point Z is the output of the horizontal polarization feed line 14 while the antenna 10 is receiving. As indicated above, at point Z, the horizontal signal is received without cancelation or attenuation as desired while no vertical polarization signal is received, which indicates that one element can be used for both polarizations simultaneously without cancellation or attenuation issues.

Figure 2:
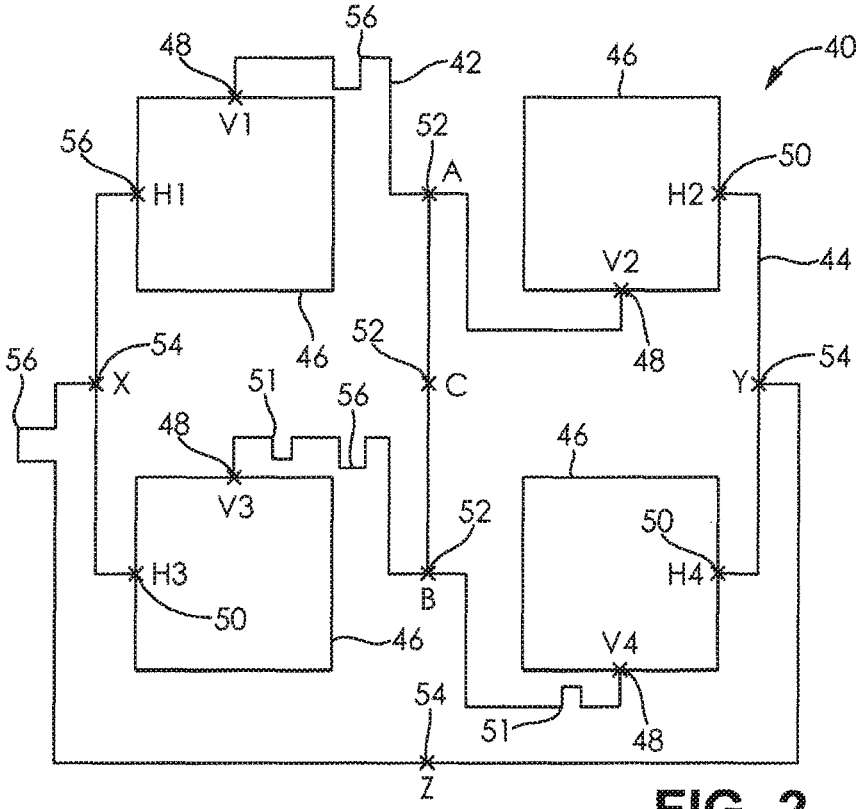
FIG. 2 shows an antenna having vertical and horizontal polarization feed lines with elevation scanning in accordance with a second embodiment of the invention.

FIG. 2 shows an antenna 40 having vertical and horizontal polarization feed lines with elevation scanning. The antenna 40 transmits and receives in two polarizations, such as in two linear polarizations, such as vertical and horizontal polarizations. However, embodiments of the invention are equally applicable to circular polarization as well. Line 42 represents a vertical polarization feed line, line 44 represents a horizontal polarization feed line, and squares represent antenna elements 46. Feed points H1, H2, H3, H4 represent horizontal polarization feed points 50, and feed points V1, V2, V3, V4 represent vertical polarization feed points 48. A, B and C represent connection points 52 for the vertical polarization feed line 42, and X, Y and Z represent connection points 54 for the horizontal polarization feed line 44.

FIG. 2 shows an embodiment of the invention including a single element for dual linear polarization, which is equally applicable to all types of antennas. Signals arriving from connection point V1 to connection point A, connection point V3 to connection point B, and connection point X to connection point Z experience an additional 180-degree phase shift either due to an additional length of conductor 56 for a narrowband signal or a phase shifter with a 180° hybrid (not shown) for wideband applications. That is, if the application is narrowband, an additional length of conductor is used, and if the application is wideband, a 180° hybrid is used. In broadband applications, the 180° phase shift can be added by using hybrids, digital phase shifters, and/or analog phase shifters. Elevation scanning is implemented by applying a θ° phase shift 51 in the vertical polarization feed line 42.

In a first example implementation of the embodiment shown in FIG. 2, horizontal polarization is received by the vertical polarization feed line 42. Specifically, signal V1 is fed at vertical polarization feed point V1 at an angle of 0°, signal V2 is fed at vertical polarization feed point V2 at an angle of 0° , signal V3 is fed at vertical polarization feed point V3 at an angle of 0°, and signal V4 is fed at vertical polarization feed point V4 at an angle of 0°. For normalized feed signals, V1=V2=V3=V4=1. The signal at connection point A equals V1 at 180°+V2 at 0° or −V1 at 0°+V2 at 0°, which is equal to 0, and the signal at connection point B equals V3 at (180+θ)°+V4 at θ° or −V3 at θ°+V4 at θ°, which equals 0. Therefore, the signal at connection point C is equal to −V1 at 0°+V2 at 0°−V3 at θ°+V4 at θ°, which equals 0. Since the magnitudes of the signals are equal, the signals cancel each other, which indicate that undesirable horizontal polarization signal magnitudes are not received by the vertical polarization feed line. Point C is the output of the vertical polarization feed line 42 while the antenna 40 is receiving. As indicated above, no horizontal polarization signal is received at connection point C. The isolation is increased to infinity, which indicates that one element can be used for both polarizations simultaneously without isolation issues.

In a second example implementation of the embodiment shown in FIG. 2, vertical polarization is received by the vertical polarization feed line 42. Specifically, signal V1 is fed at vertical polarization feed point V1 at an angle of 180°, signal V2 is fed at vertical polarization feed point V2 at an angle of 0°, signal V3 is fed at vertical polarization feed point V3 at an angle of 180°, and signal V4 is fed at vertical polarization feed point V4 at an angle of 0°. For normalized feed signals, V1=V2=V3=V4=1. The signal at connection point A equals V1 at 360°+V2 at 0° or V1 at 0°+V2 at 0°, and the signal at connection point B equals V3 at (360+θ)°+V4 at θ° or V3 at θ°+V4 at θ°. All four signals add at connection point C to equal V1 at 0°+V2 at 0°+V3 at θ°+V4 at θ°. This result indicates that a vertical polarization signal can be received and transmitted from the vertical polarization feed line 42 without cancellation or degradation. Point C is the output of the vertical polarization feed line 42 while the antenna 40 is receiving. As shown above at point C, the vertical signal is received without cancelation or attenuation as desired while no horizontal polarization signal is received, which indicates that one element can be used for both polarizations simultaneously without cancellation or attenuation issues.

In a third example implementation of the embodiment shown in FIG. 2, vertical polarization is received by the horizontal polarization feed line 44. Specifically, signal H1 is fed at horizontal polarization feed point H1 at an angle of 0°, signal H2 is fed at horizontal polarization feed point H2 at an angle of 0°, signal H3 is fed at horizontal polarization feed point H3 at an angle of θ°, and signal H4 is fed at horizontal polarization feed point H4 at an angle of θ°. For normalized feed signals, H1=H2=H3=H4=1. The signal at connection point X equals H1 at 0°+H3 at θ°, and the signal at connection point Y equals H2 at 0°+H4 at θ°. All four signals add at connection point Z to equal H1 at 180°+H2 at 0°+H3 at (180+θ)°+H4 at (180+θ)°. Therefore, the signal at connection point Z is equal to −H1 at 0°+H2 at 0°−H3 at θ°+H4 at θ°, which equals 0. Since the magnitudes of the signals are equal, the signals cancel each other, which indicates that the magnitude of undesirable vertical polarization signals become zero at connection point Z, which is the horizontal polarization feed point. Connection point Z is the output of the horizontal polarization feed line 44 while the antenna 40 is receiving. As indicated above, no vertical polarization signal is received at point Z. The isolation is increased to infinity, which shows that one element can be used for both polarizations simultaneously without isolation issues.

In a fourth example implementation of the embodiment shown in FIG. 2, horizontal polarization is received by the horizontal polarization feed line 44. Specifically, signal H1 is fed at horizontal polarization feed point H1 at an angle of 180°, signal H2 is fed at horizontal polarization feed point H2 at an angle of 0°, signal H3 is fed at horizontal polarization feed point H3 at an angle of 180°, and signal H4 is fed at horizontal polarization feed point H4 at an angle of 0°. For normalized feed signals, H1=H2=H3=H4=1. The signal at connection point X equals H1 at 180°+H3 at 180°, and the signal at connection point Y equals H2 at 0°+H4 at 0°. All four signals add at connection point Z to equal H1 at 360°+H2 at 0°+H3 at 360°+H4 at 0°. Since a 360° degree phase shift is equivalent to a 0° degree phase shift, the signal at point Z can be rewritten as H1 at 0°+H2 at 0°+H3 at 0°+H4 at 0°. This result indicates that a horizontal polarization signal can be received and transmitted from the horizontal polarization feed line 44 without cancellation or degradation. Point Z is the output of the horizontal polarization feed line 44 while the antenna 40 is receiving. As discussed above, at connection point Z, the horizontal signal is received without cancelation or attenuation as desired while no vertical polarization signal is received, which indicates that one element can be used for both polarizations simultaneously without cancellation or attenuation issues.

Figure 3:
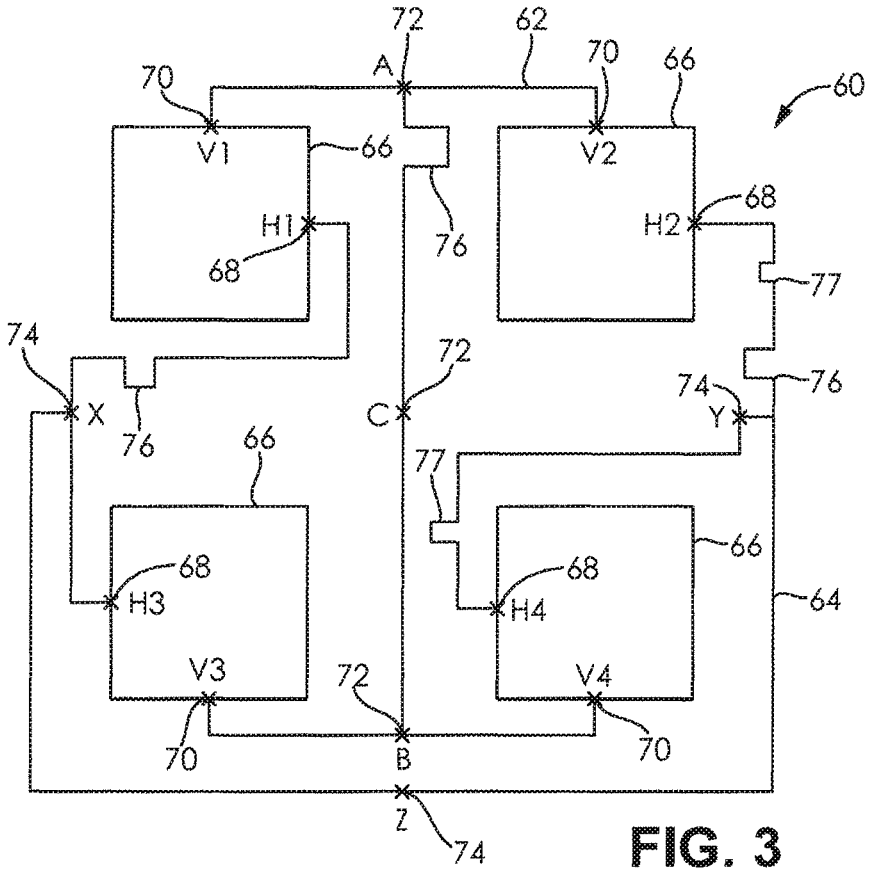
FIG. 3 shows an antenna having vertical and horizontal polarization feed lines with azimuth scanning in accordance with a third embodiment of the invention.

FIG. 3 shows an antenna 60 having vertical and horizontal polarization feed lines with azimuth scanning The antenna 60 transmits and receives in two polarizations, such as in two linear polarizations, such as vertical and horizontal polarizations. However, embodiments of the invention are equally applicable to circular polarizations as well. Line 62 represents a vertical polarization feed line, line 64 represents a horizontal polarization feed line, and squares represent antenna elements 66. Feed points H1, H2, H3, H4 represent horizontal polarization feed points 68, and feed points V1, V2, V3, V4 represent vertical polarization feed points 70. A, B and C represent connection points 72 for the vertical polarization feed line 62, and X, Y and Z represent connection points 74 for the horizontal polarization feed line 64.

FIG. 3 shows an embodiment of the invention including a single element for dual linear polarization, which is equally applicable to all types of antennas. Signals arriving from connection point A to connection point C, connection point H1 to connection point X, and connection point H2 to connection point Y experience an additional 180-degree phase shift either due to an additional length of conductor 76 for a narrowband signal or a phase shifter with a 180° hybrid (not shown) for a wide-band signal. That is, if the application is narrowband, an additional length of conductor is used, and if the application is wideband, a 180° hybrid is used. In broadband applications, the 180° phase shift can be added by using hybrids, digital phase shifters, and/or analog phase shifters. Elevation scanning is implemented by applying a θ° phase shift 77 in the horizontal polarization feed line 64.

In a first example implementation of the embodiment shown in FIG. 3, vertical polarization is received by the horizontal polarization feed line 64. Specifically, signal H1 is fed at horizontal polarization feed point H1 at an angle of 0°, signal H2 is fed at horizontal polarization feed point H2 at an angle of 0°, signal H3 is fed at horizontal polarization feed point H3 at an angle of 0°, and signal H4 is fed at horizontal polarization feed point H4 at an angle of 0°. For normalized feed signals, H1=H2=H3=H4=1. The signal at connection point X 74 equals H1 at 180°+H3 at 0°, and the signal at connection point Y equals H2 at (180+θ)°+H4 at θ°. Therefore, since the signals differ by 180° and have the same magnitude, the signals cancel each other, which indicate that undesirable vertical polarization signal magnitudes are not received by the horizontal polarization feed line 64. Therefore, complete isolation between polarizations is achieved. Connection point Z is the output of the horizontal polarization feed line 64 while the antenna 60 is receiving. As discussed above, no vertical polarization signal is received at point Z. The isolation is increased to infinity, which indicates that one element can be used for both polarizations simultaneously without isolation issues.

In a second example implementation of the embodiment shown in FIG. 3, horizontal polarization is received by the horizontal polarization feed line 64. Specifically, signal H1 is fed at horizontal polarization feed point H1 at an angle of 180°, signal H2 is fed at horizontal polarization feed point H2 at an angle of 180°, signal H3 is fed at horizontal polarization feed point H3 at an angle of 0°, and signal H4 is fed at horizontal polarization feed point H4 at an angle of 0°. For normalized feed signals, H1=H2=H3=H4=1. The signal at connection point X equals H1 at 360°+H3 at 0° or H1 at 0°+H3 at 0°, and the signal at connection point Y equals H2 at (360+θ)°+H4 at θ° or H2 at θ°+H4 at θ°. All four signals add at connection point Z to equal H1 at 0°+H2 at 0°+H3 at θ°+H4 at θ°. This result indicates that a horizontal polarization signal can be received and transmitted from the horizontal polarization feed line 64 without any cancellation or degradation. Point Z is the output of the horizontal polarization feed line 64 while the antenna 60 is receiving. As discussed above, at point Z, the horizontal signal is received without cancelation or attenuation as desired while no vertical polarization signal is received, which shows that one element can be used for both polarizations simultaneously without cancellation or attenuation issues.

In a third example implementation of the embodiment shown in FIG. 3, horizontal polarization is received by the vertical polarization feed line 62. Specifically, signal V1 is fed at vertical polarization feed point V1 at an angle of 0°, signal V2 is fed at vertical polarization feed point V2 at an angle of θ°, signal V3 is fed at vertical polarization feed point V3 at an angle of 0°, and signal V4 is fed at vertical polarization feed point V4 at an angle of θ°. For normalized feed signals, V1=V2=V3=V4=1. The signal at connection point A equals V1 at 0°+V2 at θ°, and the signal at connection point B equals V3 at 0°+V4 at θ°. All four signals add at connection point C to equal V1 at 180°+V2 at (180+θ)°+V3 at 0°+V4 at θ°. Therefore, the signal at connection point C is equal to +V1 at 0°−V2 at θ°+V3 at θ°+V4 at θ°, which equals 0. Since the magnitudes of the signals are equal, the signals cancel each other, which indicates that the magnitude of undesirable horizontal polarization signals become zero at point C, which is the vertical polarization feed point. Point C is the output of the vertical polarization feed line 64 while the antenna 60 is receiving. As shown above, no horizontal polarization signal is received at point C. The isolation is increased to infinity, which shows that one element can be used for both polarizations simultaneously without isolation issues.

In a fourth example implementation of the embodiment shown in FIG. 3, vertical polarization is received by the vertical polarization feed line 62. Specifically, signal V1 is fed at vertical polarization feed point V1 at an angle of 180°, signal V2 is fed at vertical polarization feed point V2 at an angle of 180°, signal V3 is fed at vertical polarization feed point V3 at an angle of 0°, and signal V4 is fed at vertical polarization feed point V4 at an angle of 0°. For normalized feed signals, V1=V2=V3=V4=1. The signal at connection point A equals V1 at 180°+V2 at 180°, and the signal at connection point B equals V3 at 0°+V4 at 180°. All four signals add up at connection point C to equal V1 at 360°+V2 at 360°+V3 at 0°+V4 at 0°. Since a 360° degree phase shift is equivalent to a 0° degree phase shift, the signal at connection point C can be rewritten as V1 at 0°+V2 at 0°+V3 at 0°+V4 at 0°. This result indicates that the vertical polarization signal can be received and transmitted from the vertical polarization feed line 62 without cancellation or degradation. Point C is the output of the vertical polarization feed line 62 while the antenna 60 is receiving. As indicated above, at point C, the vertical signal is received without any cancelation or attenuation as desired while no horizontal polarization signal is received, which indicates that one element can be used for both polarizations simultaneously without cancellation or attenuation issues.

Figure 4:
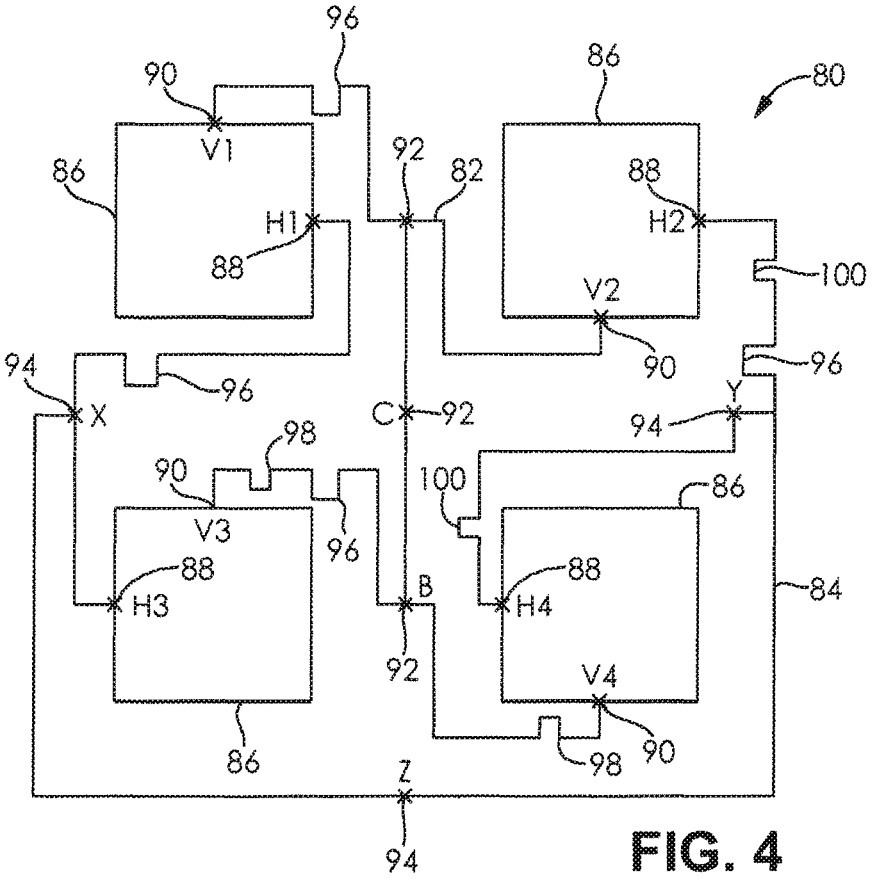
FIG. 4 shows an antenna having vertical and horizontal polarization feed lines with azimuth and elevation scanning in accordance with a fourth embodiment of the invention.

FIG. 4 shows an antenna 80 having vertical and horizontal polarization feed lines 82, 84 with azimuth and elevation scanning. The antenna 80 transmits and receives in two polarizations, such as in two linear polarizations, such as vertical and horizontal polarizations. However, embodiments of the invention are equally applicable to circular polarizations as well. Line 82 represents a vertical polarization feed line, line 84 represents a horizontal polarization feed line, and squares represent antenna elements 86. Feed points H1, H2, H3, H4 represent horizontal polarization feed points 88, and feed points V1, V2, V3, V4 represent vertical polarization feed points 90. A, B and C represent connection points 92 for the vertical polarization feed line 82, and X, Y and Z represent connection points 94 for the horizontal polarization feed line 84.

FIG. 4 shows an embodiment of the invention including a single element for dual linear polarization, which is equally applicable to all types of antennas. Signals arriving from connection point B to connection point V3, connection point A to connection point V1, and connection point H2 to connection point Y experience an additional 180-degree phase shift either due to an additional length of conductor 96 for a narrowband signal or a phase shifter with a 180° hybrid (not shown) for a wide-band signal. That is, if the application is narrowband, an additional length of conductor is used, and if application is wideband, a 180° hybrid is used. In broadband applications, the 180° phase shift can be added by using hybrids, digital phase shifters, and/or analog phase shifters. Azimuth scanning is implemented by applying a θ2° phase shift 100 in the horizontal polarization feed line 84, and elevation scanning is implemented by applying a θ1° phase shift 98 in the vertical polarization feed line 82.

To be able to steer the beam in azimuth (horizontal direction) and elevation (vertical direction), there is a phase difference between horizontal elements for azimuth steering and between vertical elements for elevation steering. FIG. 4 shows the feed line length from H2 to Y and H4 to Y is longer than from H1 to X and H3 to X, which adds the phase difference to the signal that steers the beam in azimuth. Similarly, the feed line length from V3 to B and V4 to B is longer than from V1 to A and V2 to A, which adds the phase difference to the signal that steers the beam in elevation. The additional phase may be fixed or variable. In this case, the steering angles are introduced by extra length in the feed line. However, these additional phases can also be added by digital or analog phase shifters or hybrids. These additional phase delays are referred to as θ1 phase delay 98 for elevation (vertical direction) and θ2 phase delay 100 for azimuth (horizontal direction).

In a first example implementation of the embodiment shown in FIG. 4, horizontal polarization is received by the vertical polarization feed line 82. Specifically, signal V1 is fed at vertical polarization feed point V1 at an angle of 0°, signal V2 is fed at vertical polarization feed point V2 at an angle of θ2°, signal V3 is fed at vertical polarization feed point V3 at an angle of 0°, and signal V4 is fed at vertical polarization feed point V4 at an angle of θ2°. For normalized feed signals, V1=V2=V3=V4=1. The signal at connection point A 92 equals V1 at 180°+V2 at θ2°, the signal at connection point B 92 equals V3 at (180+θ1)°+V4 at (θ1+θ2)°, and the signal at connection point C 92 equals V1 at 180°+V2 at θ2°+V3 at (180+θ1)°+V4 at (θ1+θ2)°. The magnitude of the signal in the X direction is equal to −1+cos(θ2)+cos(180+θ1)+cos(θ1+θ2), and the magnitude of the signal in the Y direction is equal to sin (θ2)+sin (180+θ1)+sin (θ1+θ2). Thus, undesirable signals are substantially attenuated by at least 6 dB. Point C is the output of the vertical polarization feed line 82 while the antenna 80 is receiving. As indicated above, no horizontal polarization signal is received at point C. The isolation is increased up to infinity, which indicates that one element can be used for both polarizations simultaneously without isolation issues.

For example, if θ1=30 and θ2=60, the magnitude of the signal in the X direction is equal to −1+cos (60)+cos (210)+cos (90), and the magnitude of the signal in the Y direction is equal to sin (60)+sin (210)+sin (90). Thus, the magnitude of the signal in the X direction equals −1.36, and the magnitude of the signal in the Y direction equals 1.36. Therefore, the magnitude of the total signal=1.92 or 5.6 dB. If the embodiment shown in FIG. 4 is not used, the magnitude of the unwanted signal at connection point C would equal 4 or 12 dB. As a result, the embodiment shown in FIG. 4 provides an improvement of 12−5.6=6.4 dB.

As another example, if θ1=60 and θ2=60, the magnitude of the signal in the X direction equals −1+cos (60)+cos (240)+cos (120), and the magnitude of the signal in the Y direction equals sin (60)+sin (240)+sin (120). Thus, the magnitude of the signal in the X direction is −1.5, and the magnitude of the signal in the Y direction is 0.86. Therefore, the magnitude of the total signal equals 1.72 or 4.7 dB. If the embodiment shown in FIG. 4 were not used, the magnitude of the unwanted signal at point C would be 4 or 12 dB. Accordingly, in this example, an improvement of 12−4.7=7.3 dB is achieved.

In a second example implementation of the embodiment shown in FIG. 4, vertical polarization is received by the vertical polarization feed line 82. Specifically, signal V1 is fed at vertical polarization feed point V1 at an angle of 180°, signal V2 is fed at vertical polarization feed point V2 at an angle of 0°, signal V3 is fed at vertical polarization feed point V3 at an angle of 180°, and signal V4 is fed at vertical polarization feed point V4 at an angle of 0°. For normalized feed signals, V1=V2=V3=V4=1. The signal at connection point A equals V1 at 360°+V2 at 0° or V1 at 0°+V2 at 0°, and the signal at connection point B equals V3 at (360+θ1)°+V4 at θ1° or V3 at θ1°+V4 at θ1°. All four signals add at connection point C to equal V1 at 0°+V2 at 0°+V3 at θ1°+V4 at θ1°. This result indicates that a vertical polarization signal can be received and transmitted from the vertical polarization feed line 82 without any cancellation or degradation. Point C is the output of the vertical polarization feed line while the antenna is receiving. As indicated above, at point C ,the vertical signal is received without any cancelation or attenuation as desired while no horizontal polarization signal is received, which indicates that one element can be used for both polarizations simultaneously without cancellation or attenuation issues.

In a third example implementation of the embodiment shown in FIG. 4, vertical polarization is received by the horizontal polarization feed line 84. Specifically, signal H1 is fed at horizontal polarization feed point H1 at an angle of 0°, signal H2 is fed at horizontal polarization feed point H2 at an angle of 0°, signal H3 is fed at horizontal polarization feed point H3 at an angle of θ1°, and signal H4 is fed at horizontal polarization feed point H4 at an angle of θ1°. For normalized feed signals, H1=H2=H3=H4=1. The signal at connection point X equals H1 at 180°+H3 at θ1°, and the signal at connection point Y equals H3 at (180+θ2)°+H4 at (θ1+θ2)°. All four signals add up at connection point Z to equal H1 at 180°+H2 at (180+θ2)°+H3 at θ1°+H4 at (θ1+θ2)°. The magnitude of the signal on the X axis equals −1+cos (180+θ2)+cos (θ1)+cos (θ1+θ2), and the magnitude of the signal on the Y axis equals sin (θ1)+sin (180+θ2)+sin (θ1+θ2). This results in an attenuation of at least 6 db in the unwanted signal. The point Z is the output of the horizontal feed line while the antenna is receiving. At point Z, only horizontal polarization signal must be received while little or no vertical polarization is received. As indicated above, no vertical signal is received at point Z. The isolation is increased up to infinity. Therefore complete isolation between polarizations is achieved in this configuration, which indicates that one element can be used for both polarizations simultaneously without isolation issues.

For example, if θ1=60 and θ2=30, the magnitude of the signal in the X axes equals −1+cos (60)+cos (210)+cos (90), and the magnitude of the signal in the Y axes=sin (60)+sin (210)+sin (90). Thus, the magnitude of the signal in the X axes is −1.36, and the magnitude of the signal in the Y axes is 1.36. Therefore, the magnitude of the total signal equals 1.92 or 5.6 dB, and the magnitude of the unwanted signal at point C would be equal to 4 or 12 dB if this embodiment had not been implemented. Accordingly, in this example, a 12−5.6=6.4 dB improvement is achieved.

As another example, if θ1=60 and θ2=60, the magnitude of the signal in the X axes=−1+cos (240)+cos (60)+cos (120), and the magnitude of the signal in the Y axes=sin (60)+sin (240)+sin (120). Thus, the magnitude of the signal in the X axes is −1.5, and the magnitude of the signal in the Y axes is 0.86. Therefore, the magnitude of the total signal is 1.72 or 4.7 dB. Since the magnitude of the unwanted signal at point C would equal 4 or 12 dB without implementing this embodiment, a 12−4.7 or 7.3 dB improvement is achieved. To be able to use one element antenna for both polarizations, the isolation between two signals (vertical and horizontal) must be sufficient. In accordance with this embodiment, the isolation is improved by 7.3 dB, which indicates that one element can be used for both polarizations simultaneously.

In a fourth example implementation of the embodiment shown in FIG. 4, horizontal polarization is received by the horizontal polarization feed line 84. Specifically, signal H1 is fed at horizontal polarization feed point H1 at an angle of 180°, signal H2 is fed at horizontal polarization feed point H2 at an angle of 180°, signal H3 is fed at horizontal polarization feed point H3 at an angle of 0°, and signal H4 is fed at horizontal polarization feed point H4 at an angle of 0°. For normalized feed signals, H1=H2=H3=H4=1. The signal at connection point X equals H1 at 360°+H3 at 0°or H1 at 0°+H3 at 0°, and the signal at connection point Y equals H2 at (360+θ2)°+H4 at θ2° or H2 at θ2°+H4 at θ2°. All four signals add at connection point Z to equal H1 at 0°+H2 at 0°+H3 at θ2°+V4 at θ2°. This result indicates that the horizontal polarization signal can be received and transmitted from the horizontal polarization feed line 84 without any cancellation or degradation. Point Z is the output of the horizontal polarization feed line 84 while the antenna 80 is receiving. Only horizontal polarization signals are received at point Z while little or no vertical polarization signal is received. As shown above, at point Z, a horizontal polarization signal is received without any cancelation or attenuation as desired, which indicates that one element can be used for both polarizations simultaneously without attenuation issues.

Figure 5:
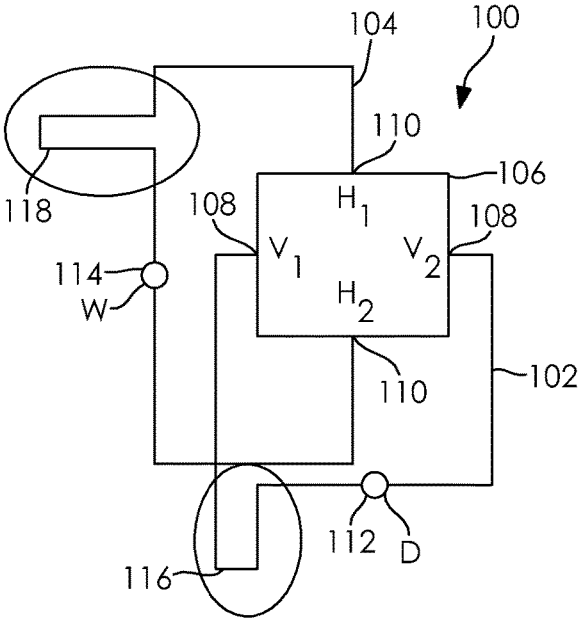
FIG. 5 shows an antenna having vertical and horizontal polarization feed lines without azimuth or elevation scanning in accordance with a fifth embodiment of the invention.

FIG. 5 shows an antenna 100 having vertical and horizontal polarization feed lines that provides isolation between polarizations without azimuth or elevation scanning The antenna 100 transmits and receives in two polarizations, such as two linear polarizations, such as vertical and horizontal polarizations. However, alternative embodiments are equally applicable to any type of polarization, such as circular polarization. Line 102 represents a vertical polarization feed line, line 104 represents a horizontal polarization feed line, and a square represents an antenna element 106. Feed points V1, V2 represent vertical polarization feed points 108, and feed points H1, H2 represent horizontal polarization feed points 110. Feed point D represents feed point 112 for the vertical polarization feed line 102, and feed point W represents feed point 114 for the horizontal polarization feed line 104.

FIG. 5 shows an embodiment including a single element for dual linear polarization, which is equally applicable to all types of antennas. Signals travelling between feed point D and feed point V1 and signals travelling between feed point W and feed point H1 experience an additional 180-degree phase shift 116, 118, respectively, either due to an additional length of conductor 116, 118 for a narrowband signal or a phase shifter with a 180° hybrid (not shown) for a wideband signal. That is, in narrowband applications, such as those with bit rates less than or equal to 1.544 Mbps, the additional length of conductor is used, and for wideband applications, such as those having bit rates of 64 Kbps to 2 Mbps, the 180° hybrid is used. In broadband applications, the 180° phase shift can be implemented by using hybrids, digital phase shifters, and/or analog phase shifters.

In a first example concerning the embodiment shown in FIG. 5, horizontal polarization is received by a vertical feed line 102. Specifically, signal V1 is fed at vertical polarization feed point V1 108 at an angle of 0°, and signal V2 is fed at vertical polarization feed point V2 108 at an angle of 0°. For normalized feed signals, V1=V2=1. The signal at feed point D equals V1 at 180°+V2 at 0°. Therefore, the signal at feed point D is equal to −V1 at 0°+V2 at 0°, which equals 0. Since the magnitudes of the signals are equal, the signals cancel each other, which indicates that undesirable horizontal polarization signal magnitudes become zero at feed point D. Feed point D is an output of the vertical polarization feed line while the antenna 100 is receiving. As indicated above, no horizontal polarization signal is received at feed point D. Thus, isolation is increased to infinity, which shows that one element can be used for both polarizations simultaneously without any isolation issues.

In a second example concerning the embodiment shown in FIG. 5, vertical polarization is received by the vertical feed line 102. Specifically, signal V1 is fed at vertical polarization feed point V1 108 at an angle of 180°, and signal V2 is fed at vertical polarization feed point V2 108 at an angle of 0°. For normalized feed signals, V1=V2=1. The signal at feed point D equals V1 at 360°+V2 at 0°. Since a 360° degree phase shift is equivalent to a 0° degree phase shift, the signal at feed point D can be rewritten as V1 at 0°+V2 at 0. This result indicates that a vertical polarization signal can be received and transmitted from the vertical feed line 102 without cancellation or degradation. Feed point D is the output of the vertical polarization feed line 102 while the antenna 100 is receiving. As indicated above, at feed point D, the vertical signal is received without cancelation or attenuation as desired while no horizontal polarization signal is received. This shows that one element can be used for both polarizations simultaneously without cancellation or attenuation issues.

In a third example concerning the embodiment shown in FIG. 5, vertical polarization is received by a horizontal feed line 104. Specifically, signal H1 is fed at horizontal polarization feed point H1 110 at an angle of 0°, and signal H2 is fed at horizontal polarization feed point H2 110 at an angle of 0°. For normalized feed signals, H1=H2=1. The signal at feed point W equals H1 at 180°+H2 at 0°. Therefore, the signal at connection point Z is equal to −H1 at 0°+H2 at 0°, which equals 0. Since the magnitudes of the signals are equal, the signals cancel each other, which indicates that the magnitude of undesirable vertical polarization signals becomes zero at feed point W, which is the horizontal polarization feed point. Therefore, complete isolation between polarizations is achieved in this configuration. Feed point W is an output of the horizontal polarization feed line 104 while the antenna 100 is receiving. As indicated above, no vertical polarization signal is received at feed point W. The isolation is increased to infinity, which indicates that one element can be used for both polarizations simultaneously without isolation issues.

In a fourth example concerning the embodiment shown in FIG. 5, horizontal polarization is received by the horizontal feed line 104. Specifically, signal H1 is fed at horizontal polarization feed point H1 at an angle of 180°, and signal H2 is fed at horizontal polarization feed point H2 at an angle of 0°. For normalized feed signals, H1=H2=1. The signal at feed point W equals H1 at 360°+H2 at 0°. Since a 360° degree phase shift is equivalent to a 0° degree phase shift, the signal at feed point W can be rewritten as H1 at 0°+H2 at 0°. This result indicates that a horizontal polarization signal can be received and transmitted from the horizontal feed line without cancellation or degradation. Feed point W is the output of the horizontal polarization feed line 104 while the antenna 100 is receiving. As indicated above, at feed point W, the horizontal signal is received without cancelation or attenuation as desired while no vertical polarization signal is received, which indicates that one element can be used for both polarizations simultaneously without cancellation or attenuation issues.

Accordingly, embodiments of the invention provide increased isolation between polarizations in an antenna by cancelling one polarization signal while another is being used. Five different feed network embodiments are shown in FIGS. 1-5. Specifically, FIG. 1 shows an embodiment which does not implement scanning, FIG. 2 shows an embodiment implementing scanning in elevation, FIG. 3 shows an embodiment implementing scanning in azimuth, FIG. 4 shows an embodiment implementing scanning in both elevation and azimuth, and FIG. 5 shows a single element embodiment that does not implement scanning in either elevation or azimuth. For the embodiments shown in FIGS. 1-3 and 5, complete isolation is achieved between polarizations, and the embodiment shown in FIG. 4 achieves at least a 6 db level of isolation.

Figure 6:
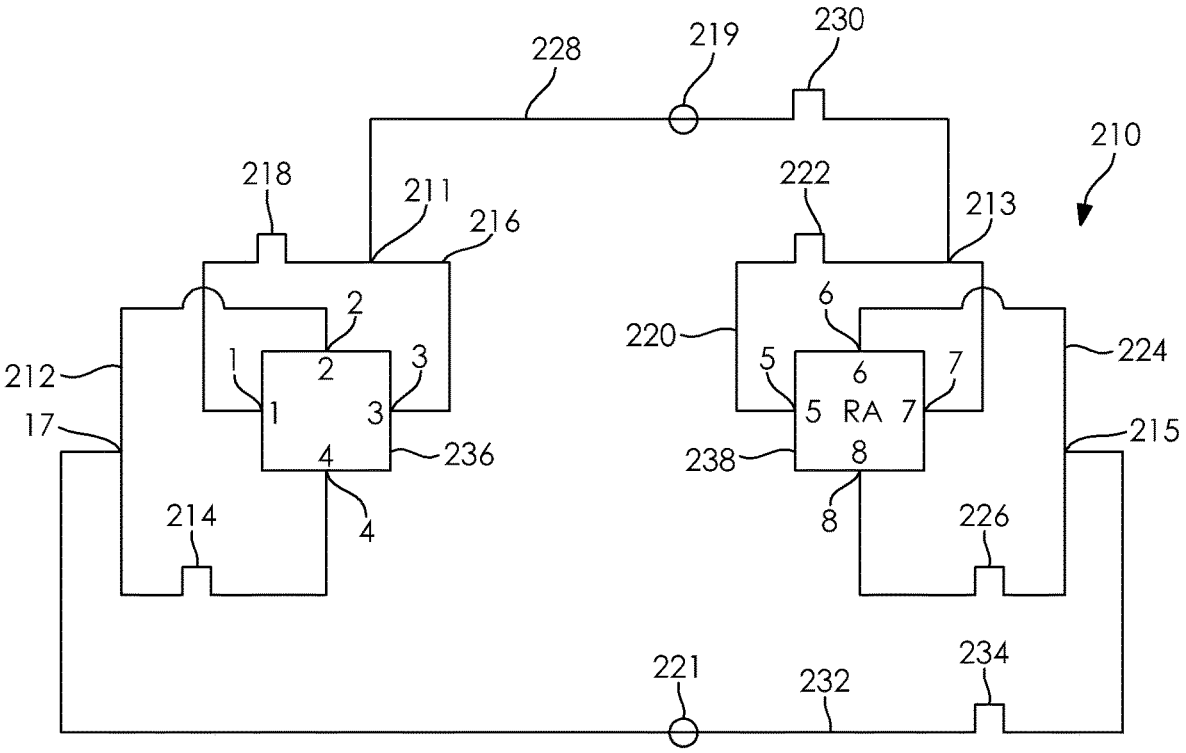
FIG. 6 is a schematic diagram illustrating a two-element antenna array in accordance with the disclosed subject matter.
Figure 7:
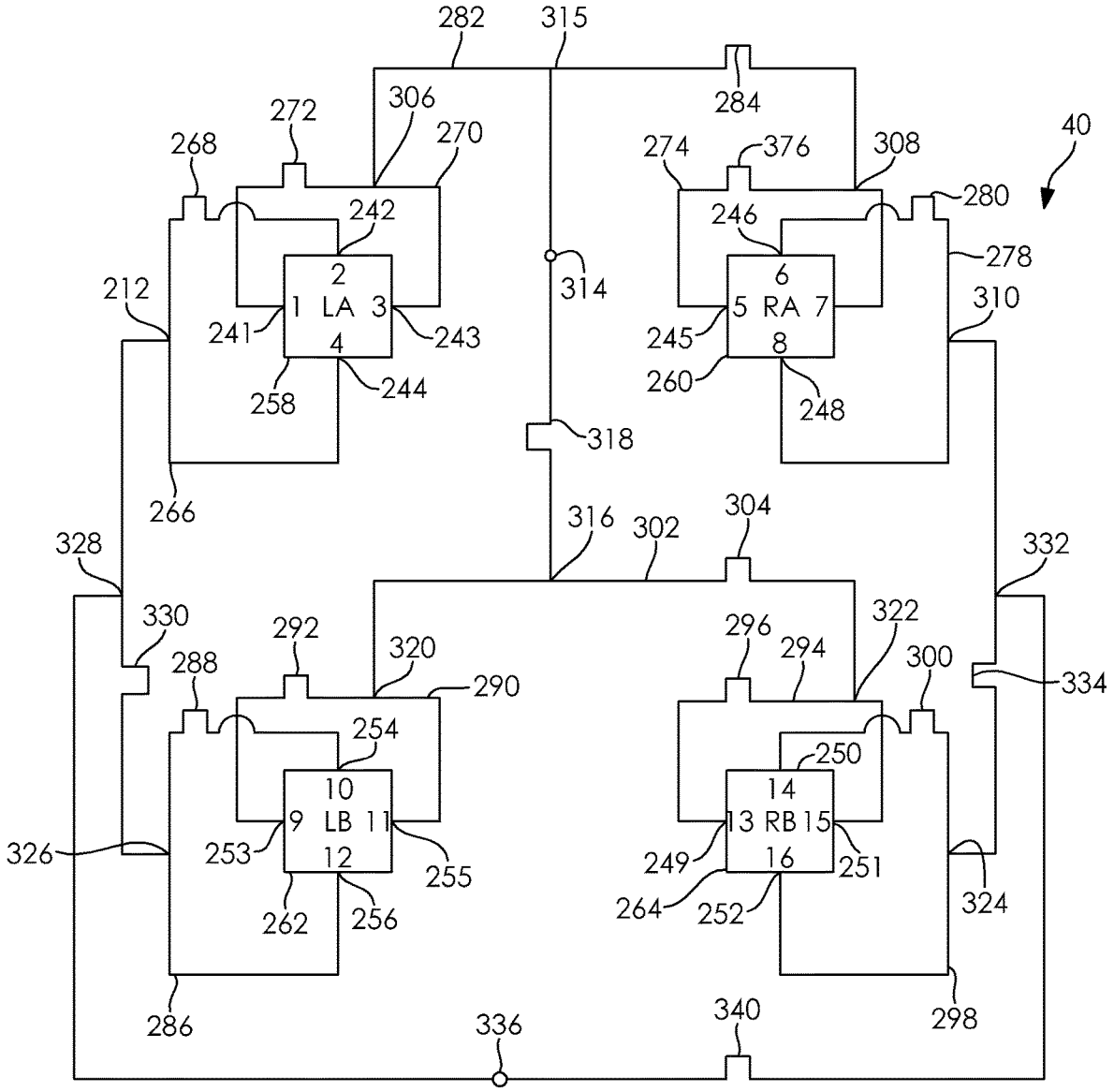
FIG. 7 shows a schematic diagram of four-element antenna array in accordance with the disclosed subject matter.

FIG. 6 illustrates a two-element antenna array system 210 that includes two (2) antenna elements configured in a horizontal row arrangement, in which a unidirectional scanning technique is applied to enable azimuth scanning An antenna array configuration for both azimuth and elevation scanning is configured with antenna elements disposed one above the other in a vertically stacked arrangement, as shown in FIG. 7.

The antenna array system 210 includes antenna elements 236, 238. The antenna elements are shown as patch antennas, but may also be implemented using one or more of a linear, dual, orthogonal polarized element antenna known in the art, such as a horizontal vertical +45, −45 antenna. The antenna element 236 includes feed points 1-4, and the antenna element 238 includes feed points 5-8. Feed points 2 and 4 are coupled by a connector 212 that includes a 180 degree phase shifter 214, and feed points 1 and 3 are coupled by a connector 216 that includes a 180 degree phase shifter 218. The connector may be implemented using a wire, coaxial cable, semi-rigid cable, radio frequency cable, microstrip, stripline, and the like. Feed points 5 and 7 are coupled by a connector 220 that includes a 180 degree phase shifter 222, and feed points 6 and 8 are coupled by a connector 224 that includes a 180 degree phase shifter 226. Feed points 3 and 7 are coupled by a connector 228 that includes a θ1 degree phase shifter 230. Feed points 2 and 6 are coupled by a connector 232 that includes a θ2 degree phase shifter 234. Thus, feed points 1 and 3 and feed points 5 and 7 are coupled by the connector 228 that includes the θ1 degree phase shifter 230. Feed points 2 and 4 and feed points 6 and 8 are coupled by the connector 232 that includes the θ2 degree phase shifter 234. It is to be noted that θ1 and θ2 may be the same or different phases. Node 211 is coupled between feed points 1 and 3, as is 180 degree phase shifter 218. Node 213 is coupled between feed points 5 and 7, as is 180 degree phase shifter 222. Node 215 is coupled between feed points 6 and 8, as is 180 degree phase shifter 226. Node 217 is coupled between feed points 2 and 4, as is 180 degree phase shifter 214. Node 219 is coupled between nodes 211 and 213, as is θ1 degree phase shifter 230. Node 221 is coupled between nodes 215 and 217, as is θ2 degree phase shifter 234. The phase shifters may be implemented using an additional length of conductor, hybrid, digital phase shifter, analog phase shifter, microstrip, stripline, and the like.

The antenna array system 210 and scanning technique are shown in relation to linearly orthogonal polarized signals. Although two antenna elements 236, 238 are shown in FIG. 6, any quantity of antenna elements may be used while remaining within the scope of the disclosed subject matter. When node 219 transmits or receives, the phase at node 213 of antenna element 238 is θ1 degrees whereas, at node 211 of antenna element 236, the phase is 0 degrees.

If there was no 180 degree phase reversal, that is, if the 180 degree phase shifter 218 was not coupled between feed points 1 and 3, the transmitted currents at feed points 1 and 3 of antenna element 236, being in opposition (i.e., on opposing sides of the antenna 236) would cancel each other, thereby eliminating radiation transmitted or received from antenna element 236. However, with the 180 degree phase reversal at feed point 1 of antenna element 236, the current at feed point 1 reverses direction and follows the direction of the current at feed point 3 of antenna element 236, thereby essentially doubling the current at feed point 3. Therefore, radiation from antenna element 236 occurs with horizontal polarization in the direction from feed point 3 to feed point 1. Similarly, for antenna element 238, the direction of horizontally polarized current is from feed point 7 to feed point 5 with an additional phase shift of θ1, thereby introducing scanning or a beam swing at an angle of φ degrees in accordance with the following equations:

$$\frac{\varphi}{2} = .5\ (\beta d\cos\varphi \pm \theta 1) = 0 \text{ (can be plus or minus } \theta 1); \tag{1}$$

$$\varphi = \beta d\cos\varphi \pm \theta 1 = 0; \tag{2}$$

$$\beta = \frac{2\pi}{\lambda};, \tag{3}$$

where d represents element spacing, which is typically provided in terms of λ, φ represents a direction of propagation, and λ, represents the operating wavelength. For example, if θ1=π, the array is an end fire array. Similarly, if θ1=0, the array is broadside array.

While this is happening, vertical polarization feed points 2 and 4 of antenna element 236 receive the same current that is traveling from feed point 3 to feed point 1 from remanence or resonance radiation. Feed point 4 of antenna element 236 receives the same current as feed point 2 of the antenna element 236, but with a 180 degree phase shift, thus reversing the direction of the current. This results in a complete cancelation of current due to vertical polarization at node 217.

Similarly, at node 215, despite the current phases at feed points 6 and 8 of antenna element 238 are θ2 degrees different from the current phases at feed points 2 and 4 of element 236, due to phase reversal at feed point 8 of antenna element 238; the currents of antenna element 238 are cancelled at feed point 215. Therefore, nodes 215, 217 exhibit complete current cancelation of the vertical polarization irrespective of the angle θ1 used for horizontal polarization. Although θ1 affects scanning of the array, θ1 does not affect the isolation in any way. Isolation is performed at each of the antenna elements, but θ1 is applied outside the elements.

When node 219 transmits or receives in the horizontal polarization, that is, when node 219 is transmitting or receiving a horizontally polarized signal, node 221 is completely isolated. Accordingly, nodes 215 and 217 are completely isolated since there is no signal at these nodes. Therefore, node 221 is also isolated since nodes 215 and 217 have no signal. Similarly, when node 221 transmits or receives in the vertical polarization, that is, when node 219 is transmitting or receiving a vertically polarized signal, the horizontal polarization at node 219 is completely isolated. The two polarizations can scan in the same direction or in different directions. Nodes 213 and 211 carry no energy, and are thus completed isolated. Therefore, node 19 is completely isolated because node 219 carries no energy. Thus, for horizontal polarization, by varying θ1, scanning in azimuth is achieved. Similarly, for vertical polarization, by varying θ2, scanning in azimuth is achieved.

Antenna elements 236, 238 are illustrated as being arranged in a horizontal row configuration in FIG. 6. If antenna elements 236, 238 are arranged in a vertical column configuration, for horizontal polarization, by varying θ1, scanning in elevation would be achieved. Similarly, for vertical polarization in the vertical column configuration, by varying θ2, scanning in elevation would be achieved.

FIG. 7 shows a four-element antenna array system 240 that scans in two directions with antenna elements 258, 262 at zero degrees and antenna elements 260, 264 at θ1 degrees, thus scanning in azimuth for the horizontal polarization. For example, if the array of left antenna elements 258, 262 is at a phase of zero degrees and the array of right antenna elements 260, 264 is at a phase of θ1 degrees, then the combination will result in the beam tilted (or scanned) at an angle of θ1, which represents scanning in azimuth. In elevation, the horizontal polarization is scanned with antenna elements 258, 260 at 0 degrees and antenna elements 262, 264 at θ3 degrees, thus achieving both azimuth and elevation beam shifting or scanning. For example, if upper antenna elements 258, 260 are at a phase of 0 degrees and lower antenna element 262, 264 are at a phase of θ3 degrees, then the combination will result in the beam being scanned in elevation. Thus, for horizontal polarization, by varying θ1, scanning in azimuth is achieved. Similarly, for horizontal polarization, by varying θ3, scanning in elevation is achieved.

The antenna element 258 includes feed points 241-244, and the antenna element 260 includes feed points 245-248.

Feed points 241, 243, 245, 247 are associated with horizontal polarization since the feed points 241, 243, 245, 247 are positioned horizontally with respect to each other. Similarly, feed points 242, 244, 246, 248 are associated with vertical polarization since the feed points 242, 244, 246, 248 are positioned vertically with respect to each other. Feed points 242, 244 are coupled by a connector 266 that includes a 180 degree phase shifter 268, and feed points 241, 243 are coupled by a connector 270 that includes a 180 degree phase shifter 272. Feed points 245, 247 are coupled by a connector 274 that includes a 180 degree phase shifter 276, and feed points 246, 248 are coupled by a connector 278 that includes a 180 degree phase shifter 280. Feed points 243, 247 are coupled by a connector 282 that includes a phase shifter 284.

The antenna element 262 includes feed points 253-256, and the antenna element 264 includes feed points 249-252. Feed points 249, 251, 253, 255 are associated with horizontal polarization since the feed points 249, 251, 253, 255 are positioned horizontally with respect to each other. Similarly, feed points 250, 252, 254, 256 are associated with vertical polarization since the feed points 250, 252, 254, 256 are positioned vertically with respect to each other. Feed points 254, 256 are coupled by a connector 286 that includes a 180 degree phase shifter 88, and feed points 253, 255 are coupled by a connector 290 that includes a 180 degree phase shifter 292. Feed points 249, 251 are coupled by a connector 294 that includes a 180 degree phase shifter 296, and feed points 250, 252 are coupled by a connector 298 that includes a 180 degree phase shifter 300. Feed points 251, 255 are coupled by a connector 302 that includes a phase shifter 304.

Node 306 is coupled between feed point 243 and 180 degree phase shifter 272, node 308 is coupled between feed point 247 and 180 degree phase shifter 276. Node 110 is coupled between feed point 248 and 180 degree phase shifter 280, and node 312 is coupled between feed point 244 and 180 degree phase shifter 268. Node 315 is coupled between node 306 and phase shifter 284, and node 316 is coupled between node 320 and phase shifter 304.

Node 320 is coupled between feed point 255 and the 180 degree phase shifter 292, node 322 is coupled between feed point 251 and 180 degree phase shifter 296. Node 324 is coupled between feed point 252 and 180 degree phase shifter 300, and node 326 is coupled between feed point 256 and 180 degree phase shifter 288. Node 328 is coupled between node 312 and phase shifter 330, which is coupled between nodes 328, 326. Node 332 is coupled between node 310 and phase shifter 334, which is coupled between nodes 324, 332. Node 336 is coupled between node 328 and phase shifter 340, which is coupled between nodes 332, 336.

For the antenna array system 240 shown in FIG. 7, the vertical polarization at nodes 310, 312, 324, 326 cancel due to the 180 degree phase shifters 268, 280, 288, 300 when compared with nodes 244, 248, 252, 256, which have a phase of 0 degrees. The result is that when node 315 transmits or receives, there is no energy transmitted or received at node 336 since nodes 310, 312, 324, 326 are completely isolated. Therefore, nodes 328, 332 do not receive any signal, so that node 336 is completely isolated. That is, in the case where horizontal polarization is transmitted or received, no vertical polarization exists because the vertical polarization has been canceled. As nodes 310, 312, 326, 324 carry no energy; node 336 also carries no energy.

Similarly, if vertical polarization is used, there is scanning in azimuth due to the phase angle θ2 applied to antenna elements 260, 264 when antenna element 258, 262 are at a phase angle equal to zero. In addition, when phase angle θ4 is applied to antenna elements 262, 264, elevation scanning occurs when the antenna elements 258, 260 are at a phase angle equal to zero. θ1 is not relevant because the signal at 306, 308, 320, and 322 is zero. Thus, for vertical polarization, by varying θ2, scanning in azimuth is achieved. Similarly, for vertical polarization, by varying θ4, scanning in elevation is achieved.

Thus, vertical polarization can be scanned in azimuth, elevation, or both azimuth and elevation. In a similar manner, the horizontal polarization at nodes 306, 308, 320, 322 are cancelled since feed points 241, 245, 249, 253 are 180 degrees out of phase with nodes 243, 247, 251 and 255, which are at a phase angle of zero. Accordingly, nodes 314, 316 are isolated and, therefore, the transmitter (or receiver) node 314 is completely isolated. Since nodes 314, 316 do not carry any energy node 315 is isolated, as there is no energy.

Figure 8:
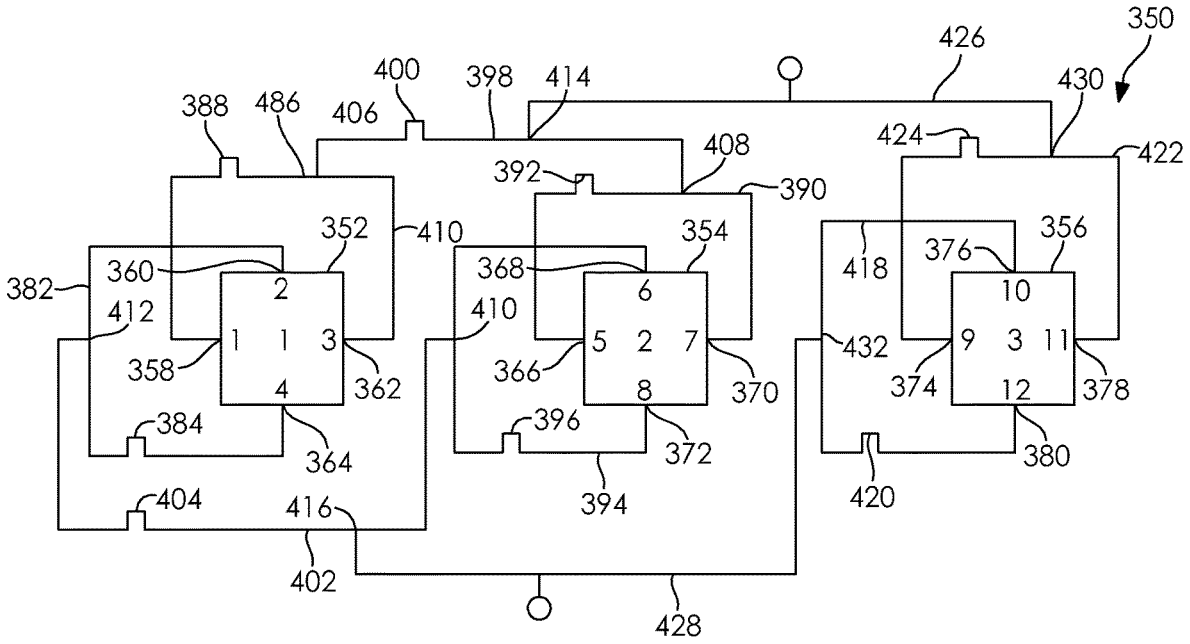
FIG. 8 shows a schematic diagram of three-element antenna array in accordance with the disclosed subject matter.

FIG. 8 illustrates a three-element antenna array system 350, which includes three (3) antenna elements but is equally applicable to any odd number of antenna elements, configured in a horizontal row arrangement, in which a unidirectional scanning technique is applied to enable azimuth scanning.

An antenna array configuration for elevation scanning is configured with antenna elements disposed one above the other in a vertically stacked arrangement, as shown in FIG. 7. Antenna elements 352, 354, 356 are illustrated as being arranged in a horizontal row configuration in FIG. 8. If antenna elements 352, 354, 356 are arranged in a vertical column configuration, for horizontal polarization, by varying θ1, scanning in elevation would be achieved. Similarly, for vertical polarization in the vertical column configuration, by varying θ2, scanning in elevation would be achieved. θ1 provided by phase shifter 400, and θ2 is provided by phase shifter 204?

The antenna array system 150 includes antenna elements 352, 354, 356. The antenna elements are shown as patch antennas, but may also be implemented using one or more of any linear, dual, orthogonal polarized element antenna known in the art, such as a horizontal vertical +45, −45 antenna. The antenna element 352 includes feed points 358, 360, 362, 364; antenna element 354 includes feed points 366, 368, 370, 372; and antenna element 156 includes feed points 374, 376, 378, 380. Feed points 360, 364 are coupled by a connector 382 that includes a 180 degree phase shifter 384, and feed points 358 and 362 are coupled by a connector 186 that includes a 180 degree phase shifter 388. The connector may be implemented using a wire, coaxial cable, semi-rigid cable, radio frequency cable, microstrip, stripline, and the like. Feed points 366 and 370 are coupled by a connector 390 that includes a 180 degree phase shifter 392, and feed points 368 and 372 are coupled by a connector 394 that includes a 180 degree phase shifter 396. Feed points 362 and 370 are coupled by a connector 398 that includes a θ1 degree phase shifter 400. Feed points 360 and 368 are coupled by a connector 402 that includes a θ2 degree phase shifter 404. Thus, feed points 358 and 362 and feed points 366 and 370 are coupled by the connector 398 that includes the θ1 degree phase shifter 400, and feed points 360 and 364 and feed points 368 and 372 are coupled by the connector 402 that includes the θ2 degree phase shifter 404. It is to be noted that θ1 and θ2 may be the same or different phases. Node 406 is coupled between feed points 358 and 362, as is 180 degree phase shifter 388. Node 408 is coupled between feed points 366 and 370, as is 180 degree phase shifter 392. Node 410 is coupled between feed points 368 and 372, as is 180 degree phase shifter 396. Node 412 is coupled between feed points 360 and 364, as is 180 degree phase shifter 384.

Node 414 is coupled between nodes 406 and 408, as is θ1 degree phase shifter 400. Node 416 is coupled between nodes 410 and 412, as is θ2 degree phase shifter 404. The phase shifters may be implemented using an additional length of conductor, hybrid, digital phase shifter, analog phase shifter, microstrip, stripline, and the like.

The antenna array system 350 and scanning technique are shown in relation to linearly orthogonal polarized signals. Although three antenna elements 352, 354, 356 are shown in FIG. 8, any quantity of antenna elements may be used while remaining within the scope of the disclosed subject matter. When node 414 transmits or receives, the phase at node 406 of antenna element 352 is θ1 degrees, whereas at node 408 of antenna element 354, the phase is 0 degrees.

If there was no 180 degree phase reversal, that is, if the 180 degree phase shifter 388 was not coupled between feed points 1 and 3, the transmitted currents at feed points 358 and 362 of antenna element 352 being in opposition would cancel each other, thereby eliminating radiation transmitted or received from antenna element 352. However, with the 180 degree phase reversal at feed point 358 of antenna element 352, the current at feed point 358 reverses direction and follows the direction of the current at feed point 362 of antenna element 352, thereby essentially doubling the current at feed point 362. Therefore, radiation from antenna element 352 occurs with horizontal polarization in the direction from feed point 362 to feed point 358. Similarly, for antenna element 354, the direction of horizontally polarized current is from feed point 370 to feed point 366 with an additional phase shift of θ1, thereby introducing a beam swing or scanning at an angle of φ degrees in accordance with the following equations:

$$\frac{\varphi}{2} = .5\ (\beta d\cos\varphi \pm \theta 1) = 0 \text{ (can be plus or minus } \theta 1); \tag{1}$$

$$\varphi = \beta d\cos\varphi \pm \theta 1 = 0; \tag{2}$$

$$\beta = \frac{2\pi}{\lambda}; \tag{3}$$

where d represents element spacing, which is typically provided in terms of λ, φ represents a direction of propagation, and λ, represents the operating wavelength. For example, if θ1=π, the array is an end fire array. Similarly, if θ1=0, the array is broadside array.

While this is happening, vertical polarization feed points 360 and 364 of antenna element 352 receive the same current that is traveling from feed point 362 to feed point 358 from remanence or resonance radiation. Feed point 364 of antenna element 352 receives the same current as feed point 360 of the antenna element 352, but with a 180 degree phase shift, thus reversing the direction of the current. This results in a complete cancelation of current due to the vertical polarization at node 412.

Similarly, at node 410, even though the current phases at feed points 368 and 372 of antenna element 354 are θ2 degrees different from the current phases at feed points 360 and 364 of element 352, due to phase reversal at feed point 372 of antenna element 354, the currents of antenna element 354 are cancelled at feed point 410. Therefore, nodes 410, 412 exhibit complete current cancelation of the vertical polarization irrespective of the angle θ1 used for horizontal polarization. Although θ1 affects the scanning of the array, θ1 does not affect the isolation in any way. Isolation is performed at each of the antenna elements, but θ1 is applied outside the elements.

When node 414 transmits or receives in the horizontal polarization, that is, when node 414 is transmitting or receiving a horizontally polarized signal, node 416 is completely isolated. At this time, nodes 410 and 412 are completely isolated, that is, there is no signal at these nodes. Therefore, node 416 is also isolated since nodes 410 and 412 have no signal. Similarly, when node 416 transmits or receives in the vertical polarization, that is when node 414 is transmitting or receiving a vertically polarized signal, the horizontal polarization at node 414 is completely isolated. The two polarizations can scan in the same direction or in different directions. Nodes 208 and 406 carry no energy, and are thus completed isolated. Therefore, node 414 is completely isolated because node 414 carries no energy.

Feed points 376 and 380 are coupled by a connector 418 that includes a 180 degree phase shifter 420, and feed points 374 and 378 are coupled by a connector 422 that includes a 180 degree phase shifter 424. The connector may be implemented using a wire, coaxial cable, semi-rigid cable, radio frequency cable, microstrip, stripline, and the like. Feed points 370 and 378 are coupled by a connector 426. Feed points 368, 376 are coupled by a connector 428. Thus, feed points 366, 370 and feed points 374, 378 are coupled by the connector 426, and feed points 368 and 372 and feed points 376 and 380 are coupled by the connector 428. It is to be noted that θ1 and θ2 may be the same or different phases. Node 430 is coupled between feed points 374 and 378, as is 180 degree phase shifter 424. Node 432 is coupled between feed points 376, 380, as is 180 degree phase shifter 420. The phase shifters may be implemented using an additional length of conductor, hybrid, digital phase shifter, analog phase shifter, microstrip, stripline, and the like.

Complete isolation occurs between two orthogonal linear polarizations at each of antenna elements 352, 354, 356. In the case where cancellation at each antenna element is not quite 100% due to remanence or resonance power, for even quantities of elements, this power is reduced by an additional 100% due to the array by, for example, nodes 217, 221 in FIG. 6, nodes 328, 336 and 314, 315 in FIG. 7. Complete (100%) cancellation occurs for arrays with an even quantity of antenna elements in accordance with the following equation:

$$\frac{\text{Quantity of elements}}{\text{Quantity of elements}}. \tag{4}$$

For arrays with an odd quantity of elements, the following equation applies:

$$\frac{\text{Quantity of elements} - 1}{\text{Quantity of elements}}. \tag{5}$$

For example, cancellation for the three-element array shown in FIG. 8 is an additional ⅔ or ~67% cancellation, that is, 100% plus ⅔ ~67% cancellation. Cancellation for the two- or four-element array shown in FIGS. 1 and 2 is 100% plus an additional 100%. Cancellation for a five-element array is ⅘ or 80% of any small amount not cancelled at 100% previously.

Although embodiments of the invention are disclosed with a specific number of elements, such as four (4) elements, the invention is not limited to four (4) elements, and is equally applicable to configurations including any multiple of four (4) elements, such as one (1), two (2), eight (8), twelve (12), or sixteen (16) elements, and the like. Further, any type of element can be used while remaining within the scope of the invention. Embodiments of the invention make it possible to use one element simultaneously for two (2) polarizations. Embodiments of the invention are also applicable to phased arrays.

Although the specification describes components and functions implemented in the embodiments with reference to particular standards and protocols, the embodiment are not limited to such standards and protocols.

The illustrations of embodiments described herein are intended to provide a general understanding of the structure of various embodiments, and the embodiments are not intended to serve as a complete description of all the elements and features of apparatus and systems that might make use of the structures described herein. Many other embodiments will be apparent to those skilled in the art upon reviewing the above description. Other embodiments are utilized and derived therefrom, such that structural and logical substitutions and changes are made without departing from the scope of this disclosure. Figures are also merely representational and are not drawn to scale. Certain proportions thereof are exaggerated, while others are decreased. Accordingly, the specification and drawings are to be regarded in an illustrative rather than a restrictive sense.

Such embodiments are referred to herein, individually and/or collectively, by the term "embodiment" merely for convenience and without intending to voluntarily limit the scope of this application to any single embodiment or inventive concept if more than one is in fact shown. Thus, although specific embodiments have been illustrated and described herein, it should be appreciated that any arrangement calculated to achieve the same purpose are substituted for the specific embodiments shown. This disclosure is intended to cover any and all adaptations or variations of various embodiments. Combinations of the above embodiments, and other embodiments not specifically described herein, will be apparent to those skilled in the art upon reviewing the above description.

In the foregoing description of the embodiments, various features are grouped together in a single embodiment for the purpose of streamlining the disclosure. This method of disclosure is not to be interpreted as reflecting that the claimed embodiments have more features than are expressly recited in each claim. Rather, as the following claims reflect, inventive subject matter lies in less than all features of a single embodiment. Thus the following claims are hereby incorporated into the detailed description, with each claim standing on its own as a separate example embodiment.

The abstract is provided to comply with 37 C.F.R. §1.72 (b), which requires an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single embodiment. Thus the following claims are hereby incorporated into the Detailed Description, with each claim standing on its own as separately claimed subject matter.

Although specific example embodiments have been described, it will be evident that various modifications and changes are made to these embodiments without departing from the broader scope of the inventive subject matter described herein. Accordingly, the specification and drawings are to be regarded in an illustrative rather than a restrictive sense. The accompanying drawings that form a part hereof, show by way of illustration, and without limitation, specific embodiments in which the subject matter are practiced. The embodiments illustrated are described in sufficient detail to enable those skilled in the art to practice the teachings herein. Other embodiments are utilized and derived therefrom, such that structural and logical substitutions and changes are made without departing from the scope of this disclosure. This Detailed Description, therefore, is not to be taken in a limiting sense, and the scope of various embodiments is defined only by the appended claims, along with the full range of equivalents to which such claims are entitled.

Given the teachings provided herein, one of ordinary skill in the art will be able to contemplate other implementations and applications of the techniques of the disclosed embodiments. Although illustrative embodiments have been described herein with reference to the accompanying drawings, it is to be understood that these embodiments are not limited to the disclosed embodiments, and that various other changes and modifications are made therein by one skilled in the art without departing from the scope of the appended claims.

What is claimed is:

1. A multi-polarized scanning phased array antenna, which comprises:

a plurality of elements, the plurality of elements comprising a first element and a second element, the first element being fed with a first polarization signal at a first feed point and a third feed point, the first element being fed with a second polarization signal at a second feed point and a fourth feed point, the second element being fed with the first polarization signal at a fifth feed point and a seventh feed point, the second element being fed with the second polarization signal at a sixth feed point and an eighth feed point, the first polarization signal comprising a first polarization, the second polarization signal comprising a second polarization, the first polarization being different from the second polarization;

a first feed line operatively coupling the plurality of elements, the first feed line being associated with the first polarization;

a second feed line operatively coupling the plurality of elements, the second feed line being associated with the second polarization;

a first 180 degree phase shifter operatively coupled in the first feed line between the first and third feed points;

a second 180 degree phase shifter operatively coupled in the second feed line between the second and fourth feed points;

a third 180 degree phase shifter operatively coupled in the first feed line between the fifth and seventh feed points;

a fourth 180 degree phase shifter operatively coupled in the second feed line between the sixth and eighth feed points;

a θ1 degree phase shifter operatively coupled in the first feed line between the third and seventh feed points; and a θ2 degree phase shifter operatively coupled in the second feed line between the second and sixth feed points.

2. The multi-polarized phased array antenna, as defined by claim 1, wherein the first feed line is bent in only right angles.

3. The multi-polarized phased array antenna, as defined by claim 1, wherein the second feed line is bent in only right angles.

4. The multi-polarized phased array antenna, as defined by claim 1, wherein the element comprises a patch antenna.

5. The multi-polarized scanning phased array antenna, as defined by claim 1, wherein the first feed line at least one of transmits and receives at least one of a vertically polarized signal, horizontally polarized signal, right-hand clockwise circularly polarized signal, and left-hand counterclockwise circularly polarized signal.

6. The multi-polarized scanning phased array antenna, as defined by claim 1, wherein the second feed line at least one of transmits and receives at least one of a vertically polarized signal, horizontally polarized signal, right-hand clockwise circularly polarized signal, and left-hand counterclockwise circularly polarized signal.

7. The multi-polarized scanning phased array antenna, as defined by claim 1, wherein the first feed line is a horizontally polarized feed line, the second feed line being a vertically polarized feed line.

8. A method of increasing isolation between polarizations in a multi-polarized scanning phased array antenna, which comprises:

coupling a plurality of elements operatively with a first feed line, the plurality of elements comprising a first element and a second element, the first element being fed with a first polarization signal at a first feed point and a third feed point, the first element being fed with a second polarization signal at a second feed point and a fourth feed point, the second element being fed with the first polarization signal at a fifth feed point and a seventh feed point, the second element being fed with the second polarization signal at a sixth feed point and an eighth feed point, the first polarization signal comprising a first polarization, the second polarization signal comprising a second polarization, the first polarization being different from the second polarization, the first feed line being associated with the first polarization;

coupling the plurality of elements operatively with a second feed line, the second feed line being associated with the second polarization;

coupling a first 180 degree phase shifter operatively in the first feed line between the first and third feed points;

coupling a second 180 degree phase shifter operatively in the second feed line between the second and fourth feed points;

coupling a third 180 degree phase shifter operatively in the first feed line between the fifth and seventh feed points;

coupling a fourth 180 degree phase shifter operatively in the second feed line between the sixth and eighth feed points;

coupling a θ1 degree phase shifter operatively in the first feed line between the third and seventh feed points; and coupling a θ2 degree phase shifter operatively in the second feed line between the second and sixth feed points.

9. The method of increasing isolation between polarizations in a multi-polarized scanning phased array antenna as defined by claim 8, further comprising bending the first feed line is bent in only right angles.

10. The method of increasing isolation between polarizations in a multi-polarized scanning phased array antenna, as defined by claim 8, further comprising bending the second feed line in only right angles.

11. The method of increasing isolation between polarizations in a multi-polarized scanning phased array antenna, as defined by claim 8, wherein the element comprises a patch antenna.

12. The method of increasing isolation between polarizations in a multi-polarized scanning phased array antenna, as defined by claim 8, further comprising at least one of transmitting, receiving by the first feed line at least one of a vertically polarized signal, horizontally polarized signal, right-hand clockwise circularly polarized signal, left-hand counterclockwise circularly polarized signal.

13. The method of increasing isolation between polarizations in a multi-polarized scanning phased array antenna, as defined by claim 8, further comprising at least one of transmitting, receiving by the second feed line at least one of a vertically polarized signal, horizontally polarized signal, right-hand clockwise circularly polarized signal, left-hand counterclockwise circularly polarized signal.

14. The method of increasing isolation between polarizations in a multi-polarized scanning phased array antenna, as defined by claim 8, wherein the first feed line is a horizontally polarized feed line, the second feed line being a vertically polarized feed line.

* * * * *